US012758024B2

(12) United States Patent
Robertson et al.

(10) Patent No.: US 12,758,024 B2
(45) Date of Patent: Oct. 13, 2026

(54) ADJUSTABLE BED

(71) Applicant: EEVOLV LTD, Cheltenham (GB)

(72) Inventors: Dale Robertson, Cheltenham (GB); Paul Brown, Cheltenham (GB)

(73) Assignee: EEVOLV LTD, Gloucestershire (GB)

( * ) Notice: Subject to any disclaimer, the term of this patent is extended or adjusted under 35 U.S.C. 154(b) by 81 days.

(21) Appl. No.: 18/849,984

(22) PCT Filed: Mar. 31, 2023

(86) PCT No.: PCT/GB2023/050877
§ 371 (c)(1),
(2) Date: Sep. 23, 2024

(87) PCT Pub. No.: WO2023/187423
PCT Pub. Date: Oct. 5, 2023

(65) Prior Publication Data

US 2025/0204692 A1 Jun. 26, 2025

(30) Foreign Application Priority Data

Mar. 31, 2022 (GB) ..... 2204737

(51) Int. Cl.
*A47C 20/06* (2006.01)

(52) U.S. Cl.
CPC ..... *A47C 20/06* (2013.01)

(58) Field of Classification Search
CPC ..... A47C 20/06; A47C 19/022; A47C 19/04; A47C 20/08; A47C 20/041
USPC ..... 5/412
See application file for complete search history.

(56) References Cited

U.S. PATENT DOCUMENTS

| | | | |
|---|---|---|---|
| 139,493 | A | 6/1873 | Bray |
| 638,466 | A | 12/1899 | Kelly |
| 912,214 | A | 2/1909 | Ward |
| 1,238,078 | A | 8/1917 | Ault |

(Continued)

FOREIGN PATENT DOCUMENTS

| | | |
|---|---|---|
| CA | 851402 | 9/1970 |
| CH | 597799 | 10/1975 |

(Continued)

OTHER PUBLICATIONS

U.S. Appl. No. 13/390,985, filed Feb. 17, 2012, Office Action mailed Jan. 7, 2015, 20 pages.

(Continued)

*Primary Examiner* — J. T. Newton
(74) *Attorney, Agent, or Firm* — Andrew F. Young, Esq.; NOLTE LACKENBACH SIEGEL

(57) ABSTRACT

A zero-wall adjustable bed (10) comprising a base (12), a support carriage (19) slidably moveable relative to the base (12), an actuator (26), a support platform (16) comprising a back support platform (18), a lower support platform (91) and a mattress bend support platform (21) positioned between the back support platform (18) and the lower support platform (20), the actuator effecting coordinated pivotal movement between the mattress bend support platform (21) and the lower support platform (20), and the mattress bend support platform (21) and the back support platform (18) as the back support platform (18) moves between lowered and raised positions.

19 Claims, 23 Drawing Sheets

(56) References Cited

U.S. PATENT DOCUMENTS

Figure 1:
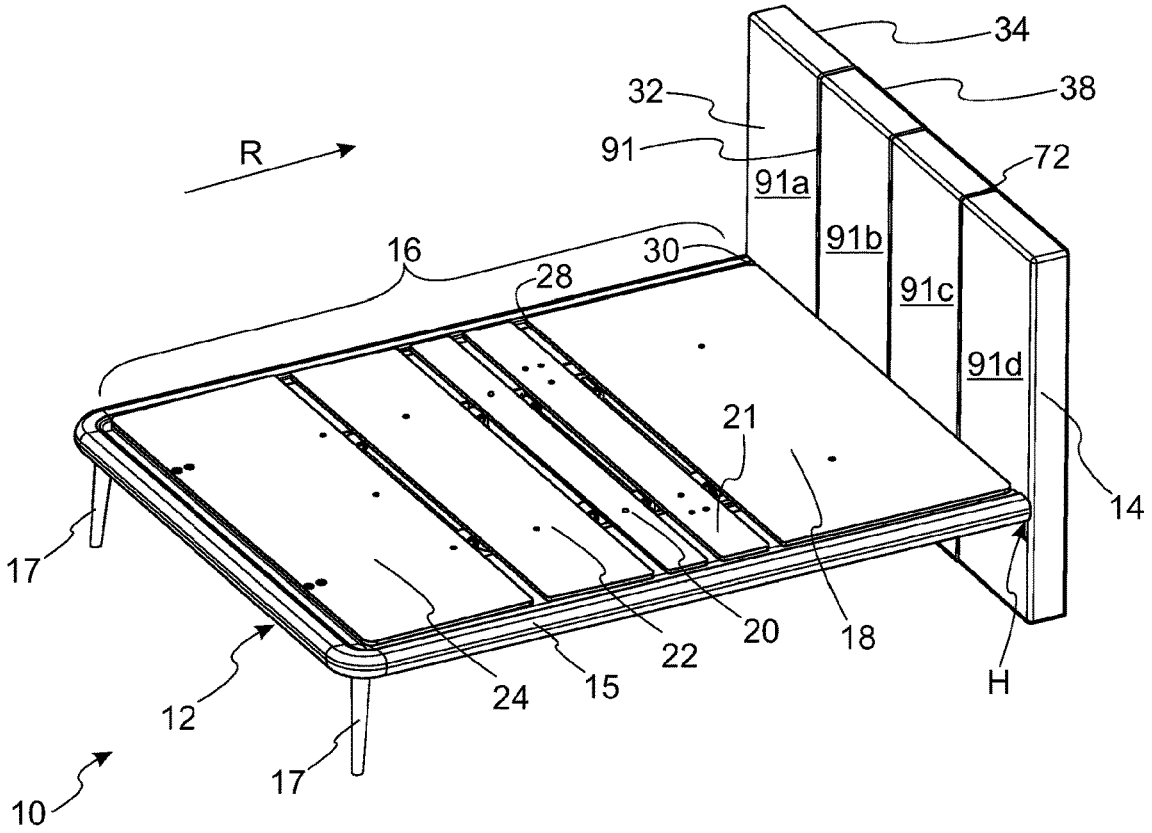

| | | | | |
|---|---|---|---|---|
| 1,414,637 | A | 5/1922 | Gell | |
| 2,497,395 | A | 2/1950 | Cramer, Sr. | |
| 2,859,797 | A | 11/1958 | Mitchelson | |
| 2,954,072 | A | 9/1960 | Fossati | |
| 3,036,862 | A | 5/1962 | Beierbach et al. | |
| 3,086,814 | A | 4/1963 | Fletcher | |
| 3,121,589 | A | 2/1964 | Schliephacke | |
| 3,202,453 | A | 8/1965 | Richards | |
| 3,281,141 | A | 10/1966 | Smiley et al. | |
| 3,369,767 | A | 2/1968 | Greenfield | |
| 3,797,050 | A | 3/1974 | Benot et al. | |
| 3,847,430 | A | 11/1974 | Fletcher | |
| 3,873,152 | A | 3/1975 | Garas | |
| 4,202,062 | A | 5/1980 | Marcyan | |
| 4,212,495 | A | 7/1980 | Gall | |
| 4,332,417 | A | 6/1982 | Mizelle | |
| 4,361,917 | A * | 12/1982 | Wilson | A47C 20/08 5/616 |
| 4,547,017 | A | 10/1985 | Lescure | |
| 4,635,999 | A | 1/1987 | Simpson | |
| 4,970,737 | A | 11/1990 | Sagel | |
| 4,996,731 | A | 3/1991 | Kruyt | |
| 5,112,109 | A | 5/1992 | Takada et al. | |
| 5,246,266 | A | 9/1993 | Ostergaard | |
| 5,625,913 | A | 5/1997 | Singleton | |
| 5,640,730 | A | 6/1997 | Godette | |
| 5,785,384 | A | 7/1998 | Sagstuen | |
| 5,819,345 | A | 10/1998 | Basgall | |
| 5,897,462 | A | 4/1999 | St. Germain | |
| 6,059,364 | A | 5/2000 | Dryburgh et al. | |
| 6,101,648 | A * | 8/2000 | Sommerfeld | A61G 7/015 5/613 |
| 6,101,649 | A * | 8/2000 | Wu | A47C 20/08 5/616 |
| 6,343,392 | B1 | 2/2002 | Becker et al. | |
| 6,568,755 | B1 | 5/2003 | Groening | |
| 6,641,214 | B2 | 11/2003 | Veneruso | |
| 6,739,661 | B1 | 5/2004 | Dukes | |
| 7,219,958 | B2 | 5/2007 | Yamazaki et al. | |
| 7,390,060 | B2 | 6/2008 | Kristen | |
| 7,445,279 | B2 | 11/2008 | Crum | |
| 7,641,277 | B2 | 1/2010 | Lawson et al. | |
| 7,703,851 | B2 | 4/2010 | Nakaya et al. | |
| 7,997,654 | B2 | 8/2011 | Ferry et al. | |
| 8,303,036 | B2 | 11/2012 | Hankinson et al. | |
| 8,403,415 | B2 | 3/2013 | Lawson | |
| 8,424,964 | B2 | 4/2013 | Campbell et al. | |
| 8,534,758 | B2 | 9/2013 | Rivera | |
| 2002/0060483 | A1 | 5/2002 | Yoshida et al. | |
| 2002/0162170 | A1 | 11/2002 | Dewert | |
| 2002/0174487 | A1 | 11/2002 | Kramer et al. | |
| 2003/0172455 | A1 | 9/2003 | Roma et al. | |
| 2004/0155504 | A1 | 8/2004 | Tada | |
| 2005/0210588 | A1 | 9/2005 | Loewenthal | |
| 2006/0143827 | A1 | 7/2006 | Wilming et al. | |
| 2007/0120409 | A1 | 5/2007 | Leeds | |
| 2007/0158980 | A1 | 7/2007 | LaPointe et al. | |
| 2007/0174487 | A1 | 7/2007 | Busey | |
| 2008/0150329 | A1 | 6/2008 | Lawson | |
| 2008/0258512 | A1 | 10/2008 | Rogers | |
| 2009/0044339 | A1 | 2/2009 | Morin et al. | |
| 2009/0178201 | A1* | 7/2009 | Lujan | A61G 7/07 5/630 |
| 2009/0211028 | A1* | 8/2009 | Richmond | A47C 20/08 5/717 |
| 2011/0248530 | A1 | 10/2011 | Sartisohn | |
| 2012/0240337 | A1 | 9/2012 | Shih | |
| 2014/0041121 | A1* | 2/2014 | Shan | A47C 21/006 5/618 |
| 2014/0103688 | A1 | 4/2014 | Wilson | |
| 2020/0154899 | A1 | 5/2020 | Brown | |

FOREIGN PATENT DOCUMENTS

| | | | |
|---|---|---|---|
| CN | 112450645 | A | 3/2021 |
| DE | 20 2007 009 068 | | 12/2007 |
| DE | 102007024218 | | 11/2008 |
| DE | 10 2007 049 118 | | 2/2009 |
| EP | 1 537 805 | | 12/2004 |
| EP | 2 524 623 | | 11/2012 |
| EP | 3281558 | A1 | 8/2017 |
| GB | 2 085 719 | | 8/1980 |
| GB | 2472920 | | 2/2014 |
| GB | 2520430 | | 11/2015 |
| GB | 2204737.7 | | 3/2022 |
| SE | C2 510 584 | | 6/1999 |
| WO | WO2004107916 | | 12/2004 |
| WO | WO 2005/107533 | | 11/2005 |
| WO | WO 2006/023447 | | 3/2006 |
| WO | WO 2008/129565 | | 10/2008 |
| WO | WO 2008/132481 | | 11/2008 |
| WO | WO/2011/021002 | | 2/2011 |
| WO | WO2011/048384 | | 4/2011 |
| WO | WO 2012/099061 | | 7/2012 |
| WO | WO 2013/061259 | | 5/2013 |
| WO | WO2017/108626 | A1 | 6/2017 |
| WO | PCT/GB2023/050877 | | 3/2023 |

OTHER PUBLICATIONS

GB 1316684.8, Search Report and Written Opinion, dated Mar. 13, 2014, 7 pages—English.
PCT/GB2015/000315, International Search Report and Written Opinion, mailed Jul. 3, 2016, 9 pages—English.
GB1422032.1, Search Report dated Apr. 29, 2015, 2 pages—English.
GB1319926.0 Search Report dated May 1, 2014, 4 pages—English.
GB1419811.3 Search Report dated Dec. 17, 2014, 7 pages—English.
PCT/GB2014/000452 Search Report and Written Opinion, 9 pages—English.
PCT/GB2015/000314, Search Report and Written Opinion, mailed Jul. 3, 2016, 9 pages.
PCT/GB2017/051722, Search Report and Written Opinion mailed Sep. 5, 2017, 17 pgs.—English.
Pat. No. GB 1417108.6, Combined Search and Examination Report dated Mar. 26, 2015, 7 pages—English.
EasyCliner® wood-to-the-floor recliner mechanism, 1 page, HomeFurnitureComponents.com, Apr. 10, 2015.
GB1313002.6, Search Report mailed Jan. 21, 2014, 4 pages.
PCT/GB2014/000274, Written Opinion mail Jan. 21, 2014, 5 pages.
PCT/GB2010/001565 International Search Report mailed Apr. 12, 2011, 6 pages—English.
PCT/GB2023/050877, International Search Report and Written Opinion dated Aug. 31, 2023, 16 pages—English.
CN 202080014968.3, Office Action dated Aug. 25, 2022, 8 pgs.—Chinese; 10 pgs.—English.
GB 1316684.8, Search Report and Written Opinion, dated Mar. 13, 2013, 4 pags.—English.
PCT/GB2014/000452 Search Report and Written Opinion dated Mar. 16, 2015; 8 pgs.—English.
GB 422032.1, Search Report dated Apr. 30, 2015, 4 pgs.—English.

* cited by examiner

ADJUSTABLE BED

CROSS REFERENCE TO RELATED APPLICATIONS

This application relates to and claims priority as a § 371 national phase, from PCT/GB2023/050877 filed Mar. 31, 2023, the entire contents of which are incorporated herein by reference, which in turn claims priority from GB 2204737.7 filed Mar. 31, 2022.

FIGURE SELECTED FOR PUBLICATION

FIG. 1

The present invention relates to an adjustable bed, in particular, an adjustable bed for use in domestic furniture applications.

An adjustable bed particularly suitable for domestic furniture applications is described in WO2011/048384. The adjustable bed comprises a plurality of mattress support platforms, including a movable back support platform, a fixed seat support platform adjacent to the back support platform, a movable thigh support platform adjacent the seat support platform and a movable foot or lower leg support platform adjacent and hinged to the thigh support platform. The back and thigh support platforms are mounted with respect to the base to allow angular adjustment of their relative positions to alter the configuration of the bed. Linear actuators are provided for moving each of the movable platforms to effect angular adjustment of the bed.

One of the drawbacks associated with adjustable beds of the aforementioned type is that the angle of elevation (included angle) between the seat platform and the raised back support platform can cause significant operational problems for both the bed and the occupant. In most settings, the angle of adjustment for the backrest will be up to 70 degrees, that is to say, the backrest can be raised up to 70 degrees from the notional horizontal plane of the bed, to raise the occupant from a flat lowered or lying position, to a raised position up to 70 degrees maximum. In other arrangements, the maximum angle of inclination may be slightly less, for example 50 degrees, 55 degrees or 60 degrees, as dependent on the particular application, whether the bed is for domestic, care home or medical use.

In a modern domestic setting, where mattress thicknesses of 12-18 inches are common, and more typically 14-18 inches in the United States, the overall weight, stiffness and rigidity of the mattress can place an unacceptable load on the operating mechanism of the bed, for example thicker, heavier mattresses can cause the motor (actuator) to struggle and reduce the longevity of the motor and mechanism. This is becoming increasingly relevant as the marketplace is driven by customer demand for thicker mattresses. Motorised adjustable beds have been known to fail after a short number of cycles using mattresses of the aforementioned thickness. One way to overcome this has been to use special, more flexible, "ribbed" mattress. However, this is not a practical solution for most applications.

A further problem associated with known designs is that the angle of elevation between the seat and the raised back support platform is not ideal ergonomically, as it does not allow the mattress to naturally crease around the user's hip joint, so the user has to continually adjust their position as the back support platform moves between lowered and raised positions.

There is also a desire for adjustable beds to not only be able to accommodate thicker mattresses and to operate more efficiently and ergonomically, but also possess zero-wall functionality, that is, enabling the position of the bed occupant to be maintained in proximity with a wall against which the head end of the bed may be arranged. This desirable functionality ensures that the occupant's position is maintained with respect to adjacent bedside furniture and the like when the bed is raised or lowered, maintaining the position of the occupant with respect to their surroundings even when the bed is adjusted to raise the occupant.

A further problem with known adjustable beds relates to the aesthetics of the bed itself, in particular, the visibility of the actuator and associated connecting means required to move the back support platform between lowered and raised positions, since, in addition to requiring beds with adjustability and comfort, users are further demanding adjustable beds without any negative impact on aesthetics.

An object of the present invention is to provide an improved adjustable bed which overcomes or at least mitigates the above-mentioned problems associated with prior art adjustable beds.

Thus according to one aspect of the present invention there is provided a zero-wall adjustable bed (10) comprising a base (12), a support carriage (19) slidably moveable relative to the base (12), an actuator (26), a support platform (16) comprising a back support platform (18), a lower support platform (91) and a mattress bend support platform (21) positioned between the back support platform (18) and the lower support platform (20), the actuator effecting coordinated pivotal movement between the mattress bend support platform (21) and the lower support platform (20), and the mattress bend support platform (21) and the back support platform (18) as the back support platform (18) moves between lowered and raised positions.

Preferably the lower support platform (91) includes at least one of a seat support platform (20), a thigh support platform (22), and a foot support platform (24).

Preferably the seat support platform (20) is pivotally attached to the mattress bend support platform (21) and the back support platform (18) is pivotally attached to the mattress bend support platform (21), the actuator effecting coordinated pivotal movement between the mattress bend support platform (21) and the seat support platform (20), and the mattress bend support platform (21) and the back support platform (18) as the back support platform (18) moves between lowered and raised positions.

Preferably a first angle ($A_1$) is defined between the seat support platform (20) or the support carriage (19) and the mattress bend support platform (21), and a second angle ($A_2$) is defined between the mattress bend support platform (21) and the back support platform (18), in which the difference between the first angle ($A_1$) and the second angle ($A_2$) is less than 10 degrees as the back support platform (18) moves between lowered and raised positions.

Preferably the first angle ($A_1$) and the second angle ($A_2$) are substantially equal as the back support platform (18) moves between lowered and raised positions.

Preferably a third angle ($A_3$) is defined between the seat support platform (20) or the support carriage (19) and the back support platform (18), in which the third angle ($A_3$) is between 0 and 70 degrees as the back support platform (18) moves between lowered and raised positions, preferably the third angle ($A_3$) is less than 70 degrees when the back support platform (18) is in the raised position.

Preferably at least part of the support platform (16) is slidably fixed to the support carriage (19)

Preferably the seat support platform (20) is slidably fixed to the support carriage (19).

Preferably a pivotal connection (695) between the lower support platform (691) and the mattress bend support platform (621) is slidably fixed to the support carriage (619).

Preferably the base (12) includes one of a mattress bend support platform guide (54) or follower, and the mattress bend support platform (21) includes the other of a mattress bend support platform guide or follower (56), such that relative movement between the mattress bend support platform guide (54) and the mattress bend support platform follower (56) causes coordinated pivotal movement between the mattress bend support platform (21) and the lower support platform (20), and the mattress bend support platform (21) and the back support platform (18) as the back support platform (18) moves between lowered and raised positions.

Preferably the mattress bend support platform guide (54) is inclined vertically upwards and rearwards towards a head end of the bed.

Preferably the mattress bend support platform guide (54) includes a straight portion, preferably defines a straight portion only.

Preferably the mattress bend support platform guide includes a curved portion, preferably defines a curved portion only (354).

Preferably the adjustable bed (510) further comprises a first connecting means (581) which acts directly on the back support platform (518) and a second connecting means (583) which acts directly on the mattress bend support platform or a pivotal point (584) connecting the back support platform (518) and the mattress bend support platform (521) such that the actuator (526) simultaneously drives both support platforms (521,526), the second connecting means (583) is driven by the actuator via the first connecting means (581), in which the second connecting means (583) is pivotally attached to the first connecting means (581) part-way along the first connecting means (581).

Preferably the first connecting means has a first end pivotally attached to the support carriage (519), and a second end free to move translationally on the back support platform (518).

Preferably the adjustable bed (510) further comprises a third connecting means (585), the third connecting means (585) is pivotally attached at a first end to the first connecting means (581) and pivotally attached at a second end to the base (512).

Preferably the actuator (226) has a first end pivotally attached to the base (212) and a second end pivotally attached to the support carriage (219) such that movement of the actuator effects sliding movement between the support carriage (219) and the base (212).

Preferably the actuator (526) has a first end pivotally attached to the third connecting means (585) and a second end pivotally attached to the support carriage (519) such that movement of the actuator effects sliding movement between the support carriage (519) and the base (512).

Preferably actuator slidably drives the support carriage.

Preferably the support carriage (19) slidably moves relative to the base (12) when the back support platform (18) moves between the lowered and raised positions.

Preferably movement of the back support platform (18) between the lowered and the raised position causes the support carriage (19) to slide rearwards towards a head end (H) of the bed.

Preferably at least one, preferably all, of a or the foot support platform (24), thigh support platform (22), back support platform (18) and mattress bend support platform (21) are pivotable relative to the seat support platform (20).

Preferably a or the foot support platform (24) is pivotally connected to a or the thigh support platform (22), and/or a or the thigh support platform (22) is pivotally connected to a or the seat support platform (20) and/or a or the seat support platform (20) is pivotally connected to a or the mattress bend support platform (21) and/or a or the mattress bend support platform is pivotally connected to a or the back support platform (18).

Preferably, a or the foot support platform (24) is pivotally connected to the thigh support platform (22), further comprising a second actuator (44) configured to simultaneously cause the foot support platform (24) to slide and pivot relative to the seat support platform (20) and pivot the thigh support platform (22) upwards relative to the seat support platform (20).

According to another aspect of the present invention there is provided an adjustable bed (10) comprising a base (12), a support platform (16), including a foot support platform (24) and a thigh support platform (22) pivotally connected to the foot support platform (24), a seat support platform (20), and a second actuator (44) configured to simultaneously cause the foot support platform (24) to slide and pivot relative to the seat support platform (20) and pivot the thigh support platform (22) upwards relative to the seat support platform (20).

Preferably the foot support platform (24) is slidable relative to the seat support platform (20) independently of relative movement between a support carriage (19) to which the seat support platform (20) is slidably fixed, and the base (12).

Preferably rearward movement of the foot support platform (24) causes the foot support platform (24) to pivot upwards relative to the seat support platform (20) and pivot the thigh support platform (22) upwards relative to the seat support platform (20).

Preferably the bed further comprises a footboard (160) slidably fixed to the support carriage (119), in which movement of the support carriage (119) relative to the base (112) causes the footboard (160) to slidably move relative to the base (112).

According to another aspect of the present invention there is provided an adjustable bed (110) comprising a base (112), a footboard (160), a support platform (116) comprising a back support platform (118) and a lower support platform (191) an actuator (126) configured to move the support platform (116) relative to the base (12), and a support carriage (119), the support carriage (119) is slidably moveable relative to the base (112), in which movement of the support carriage (119) relative to the base (112) causes the footboard (60) to slidably move relative to the base (112).

Preferably the support platform (119) further comprises a mattress bend support platform (121) positioned between the back support platform (118) and the lower support platform (191).

Preferably the support carriage (119) slidably moves relative to the base (112) when the back support platform (118) moves between a lowered and a raised position.

Preferably movement of the back support platform (118) between the lowered and the raised position causes the footboard (160) to slidably move between extended and retracted positions.

Preferably the back support platform (18) has a first end (28) adjacent another platform of the support platform (16) and a second end (30) adjacent the headboard (14), in which the actuator (26) is pivotally connected to the back support platform (18) at a point closer to the second end (30) than the first end (28).

Preferably the back support platform (18) has a first end (28) adjacent another platform of the support platform (16), and a second end (30) adjacent the headboard (14), in which the actuator (26) is pivotally connected to the back support platform (18) at or proximate the second end (30).

Preferably the headboard (14) includes a front face (32) facing the back support platform (18) and a rear face (34) opposite the front face (32), in which the first actuator (26) is mounted on the rear face (34).

Preferably the front face (32) is substantially perpendicular to an upper surface (36) of the back support platform (18) when the back support platform (18) is in a or the lowered flat position.

Preferably a longitudinal axis (L) of the first actuator (26) is arranged substantially vertically.

Preferably the first actuator (26) is substantially contained within an envelope defined by a or the front face (32) of the headboard (14) and a rearmost surface (38) of the headboard (14).

Figure 2:
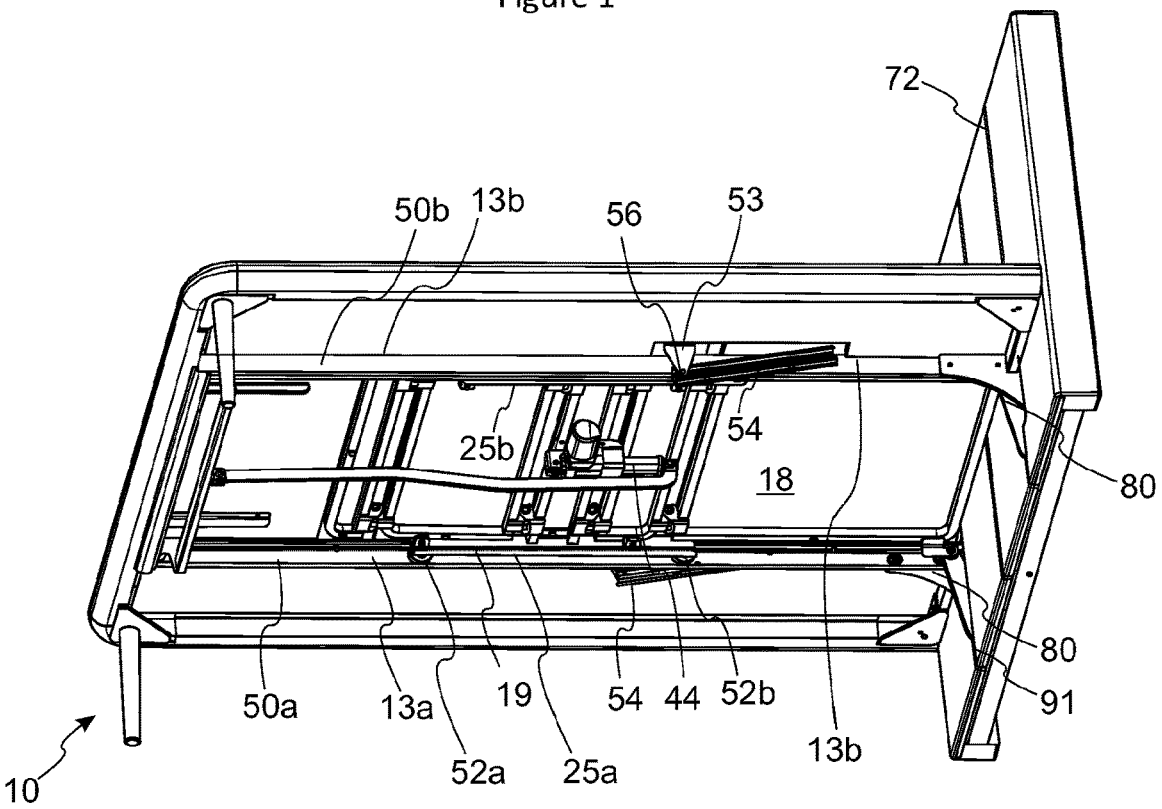
Figure 3:
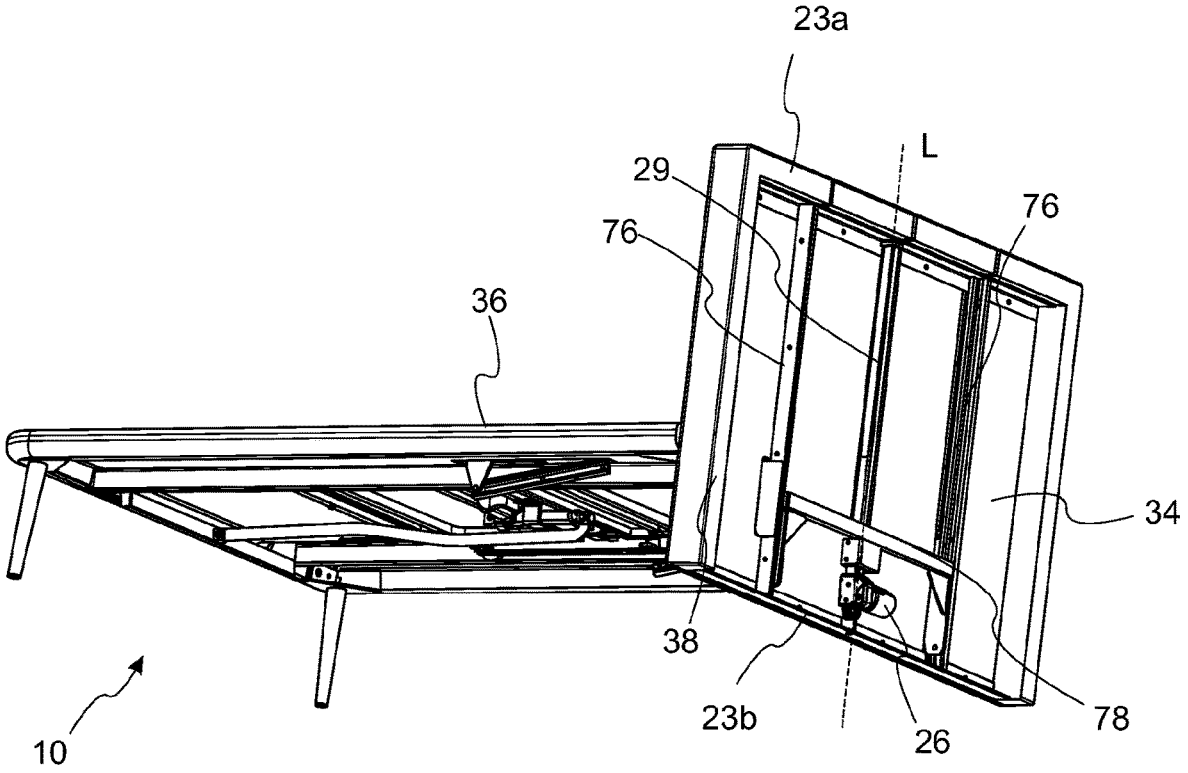
Figure 4:
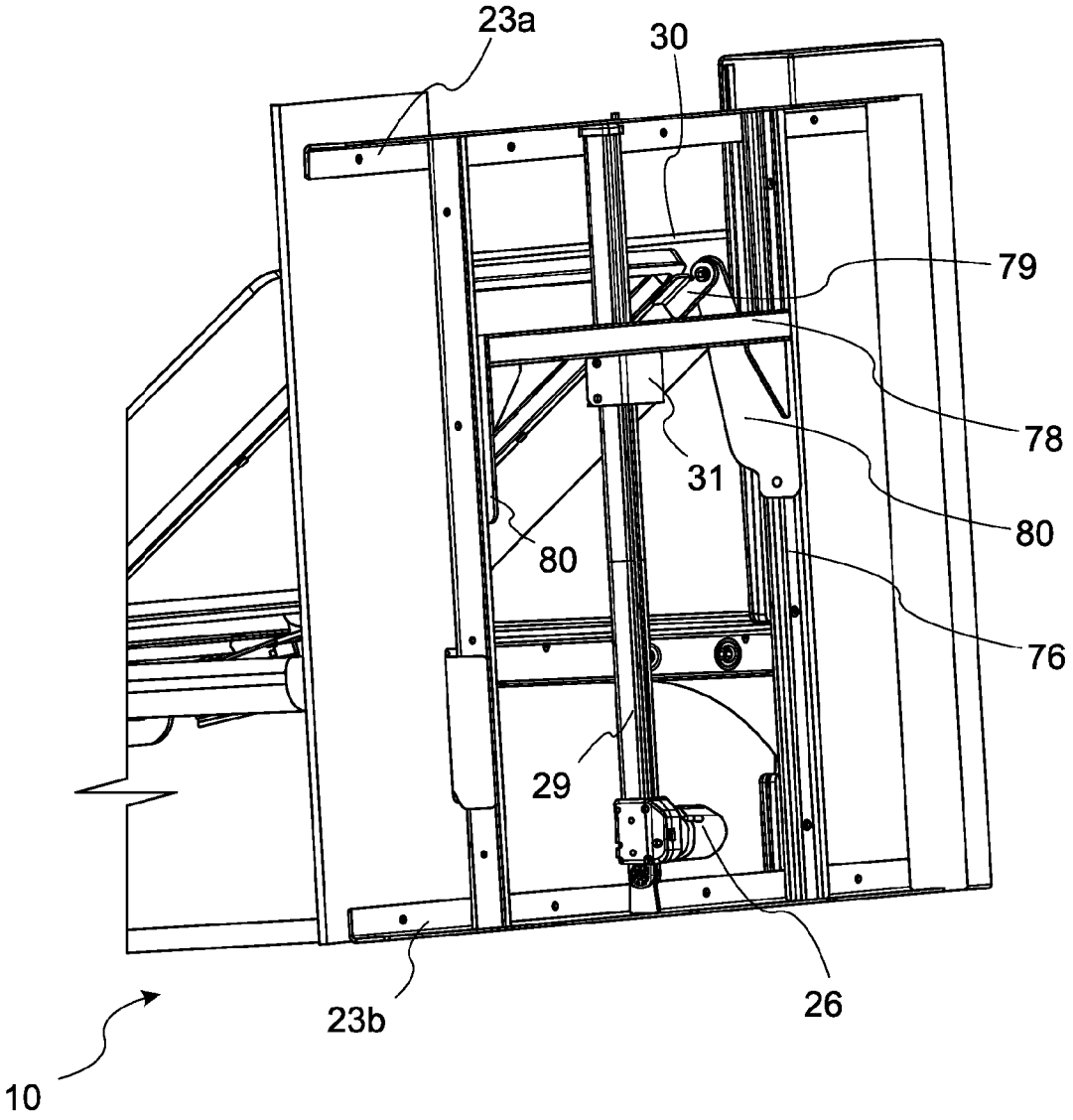
Figure 4A:
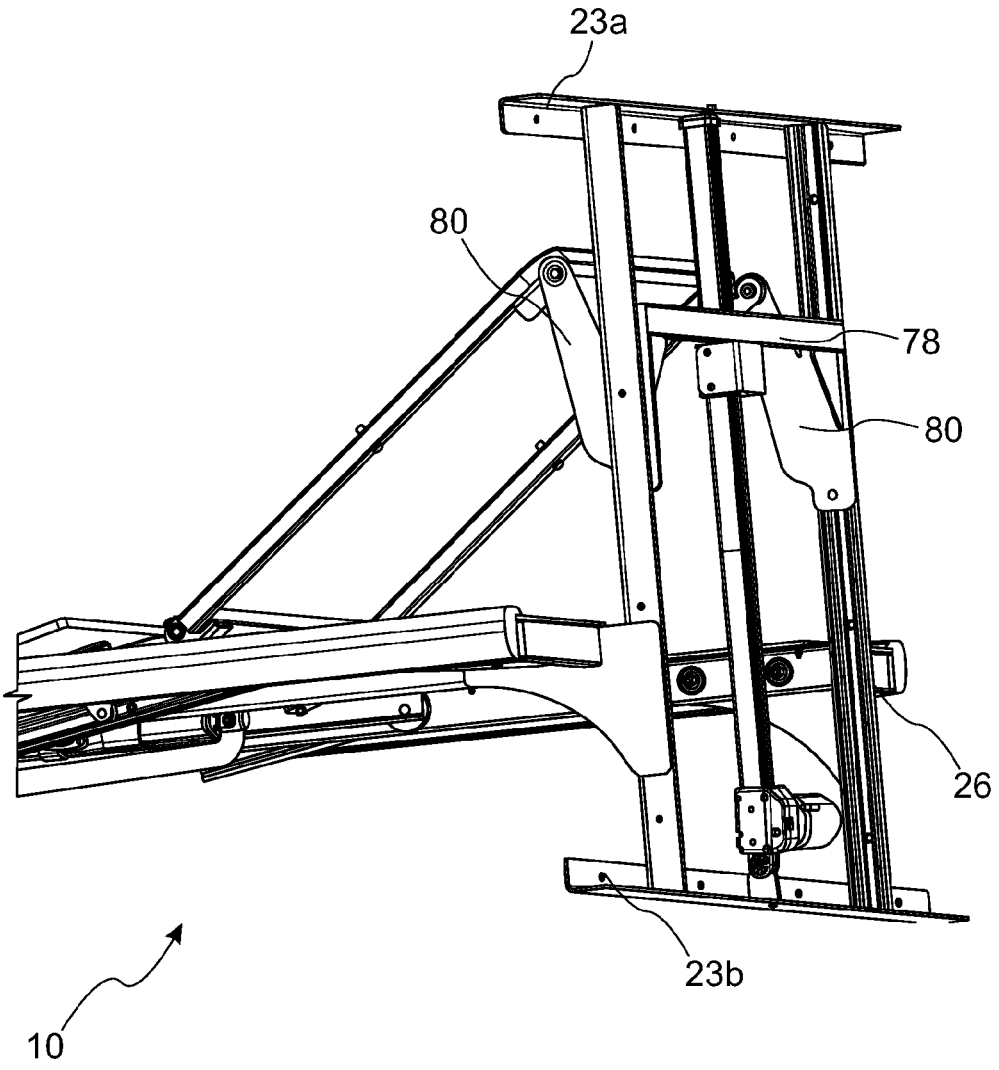
Figure 5:
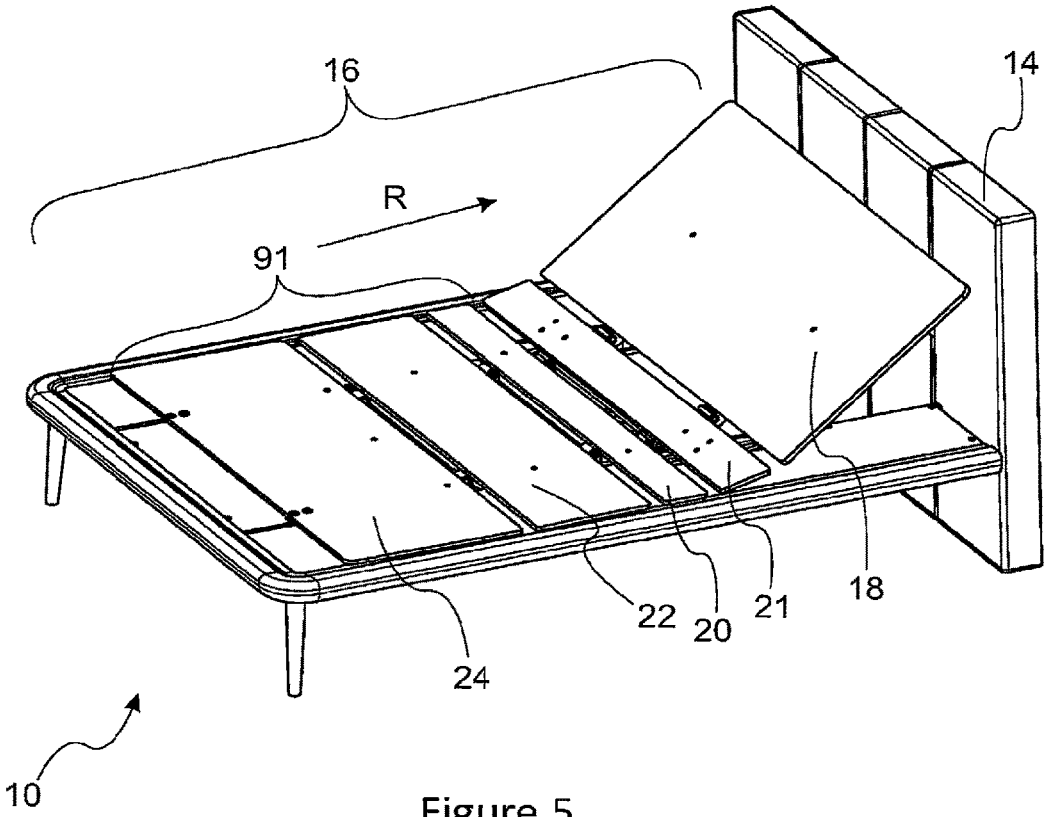
Figure 6:
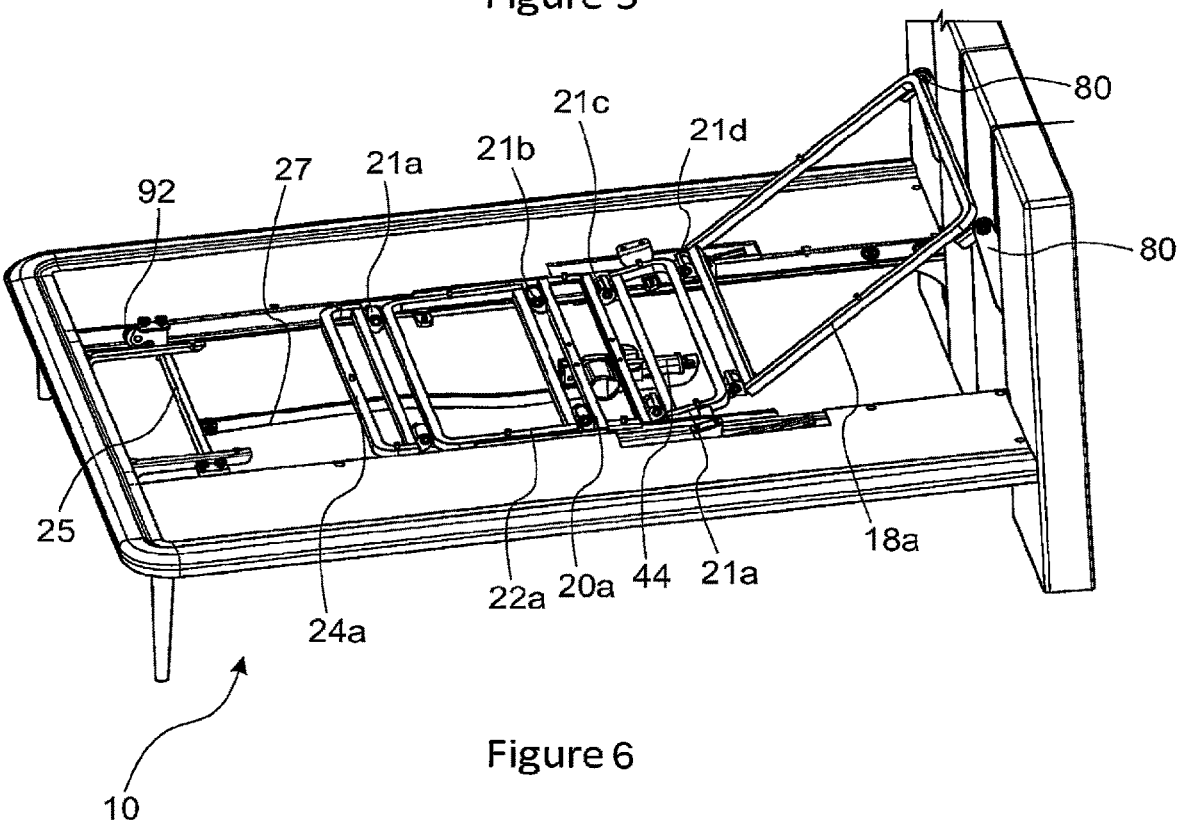
Figure 7:
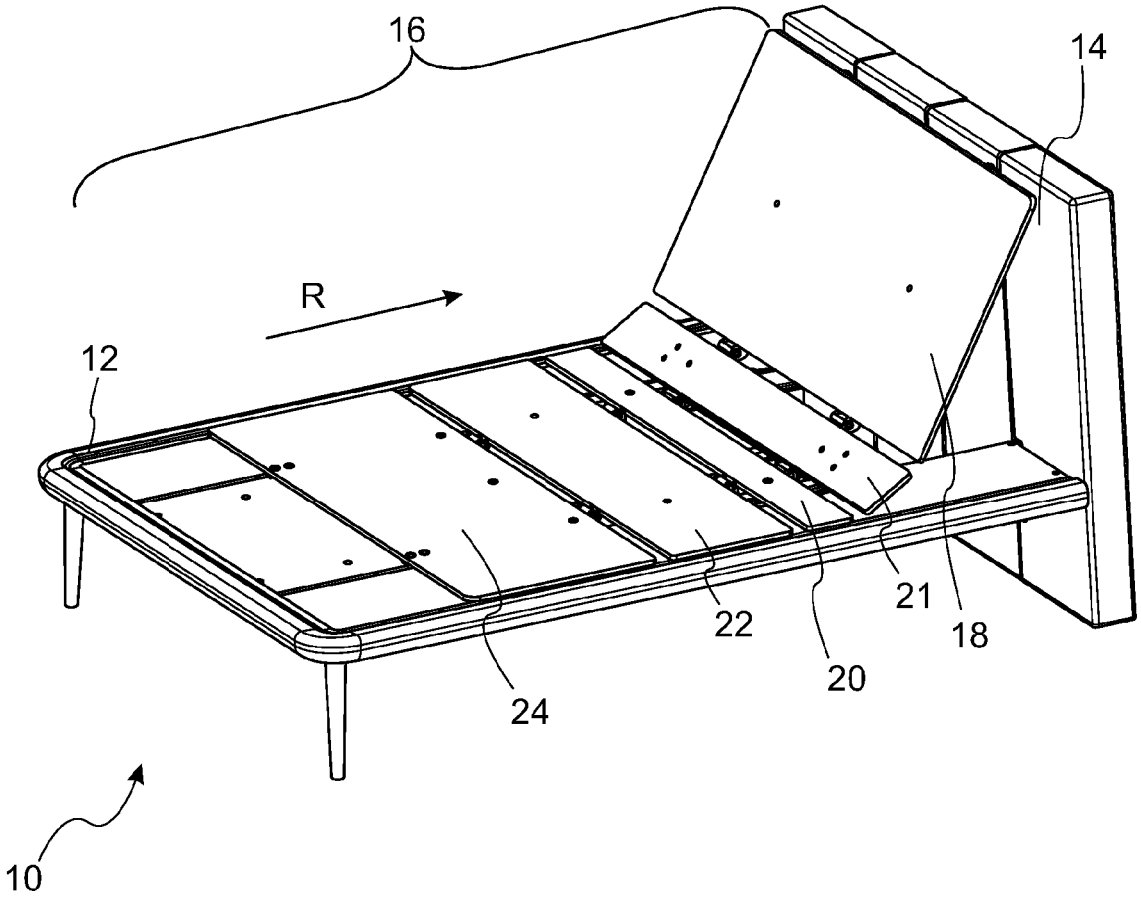
Figure 8:
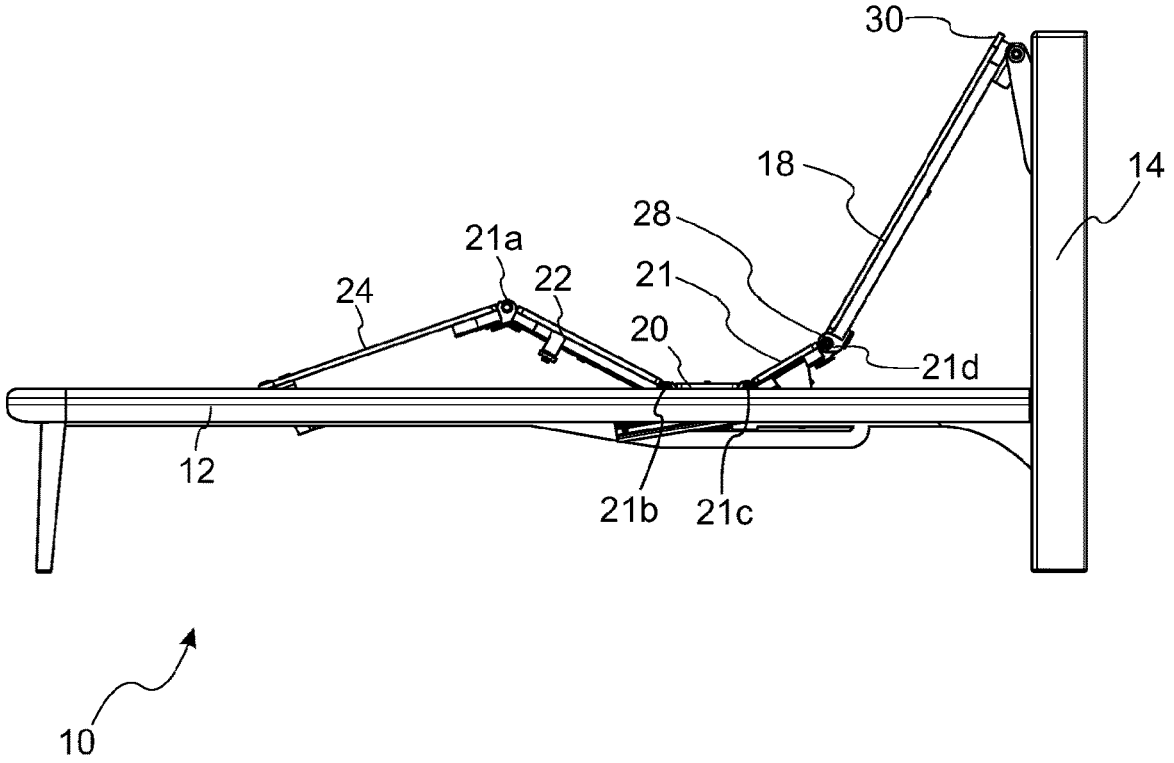
Figure 9:
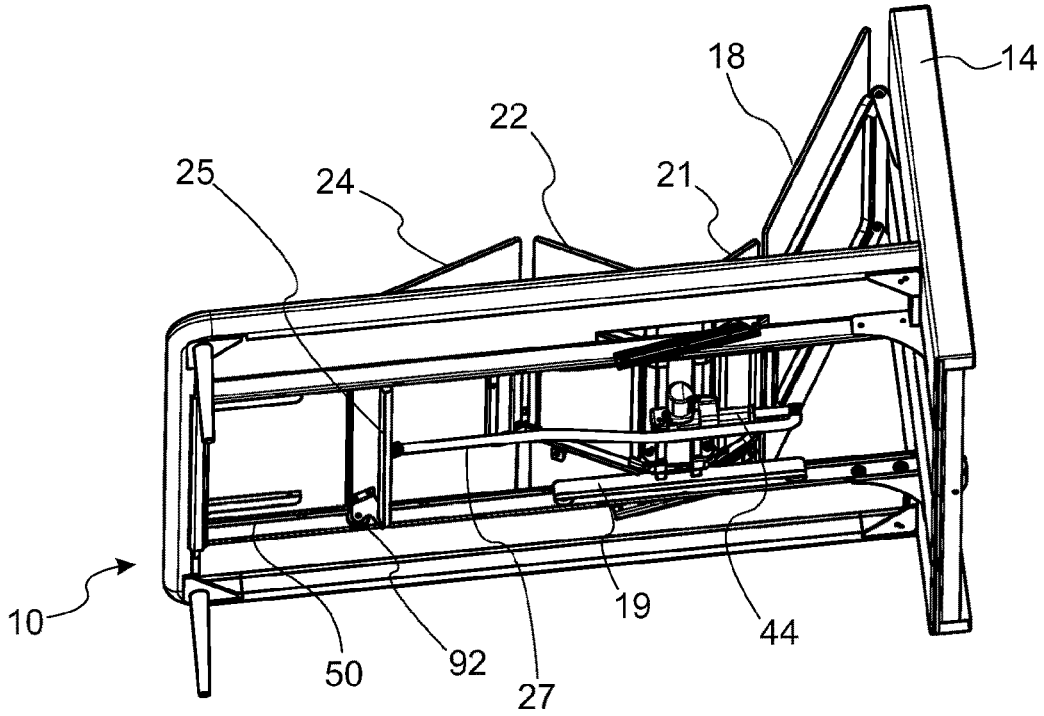
Figure 10:
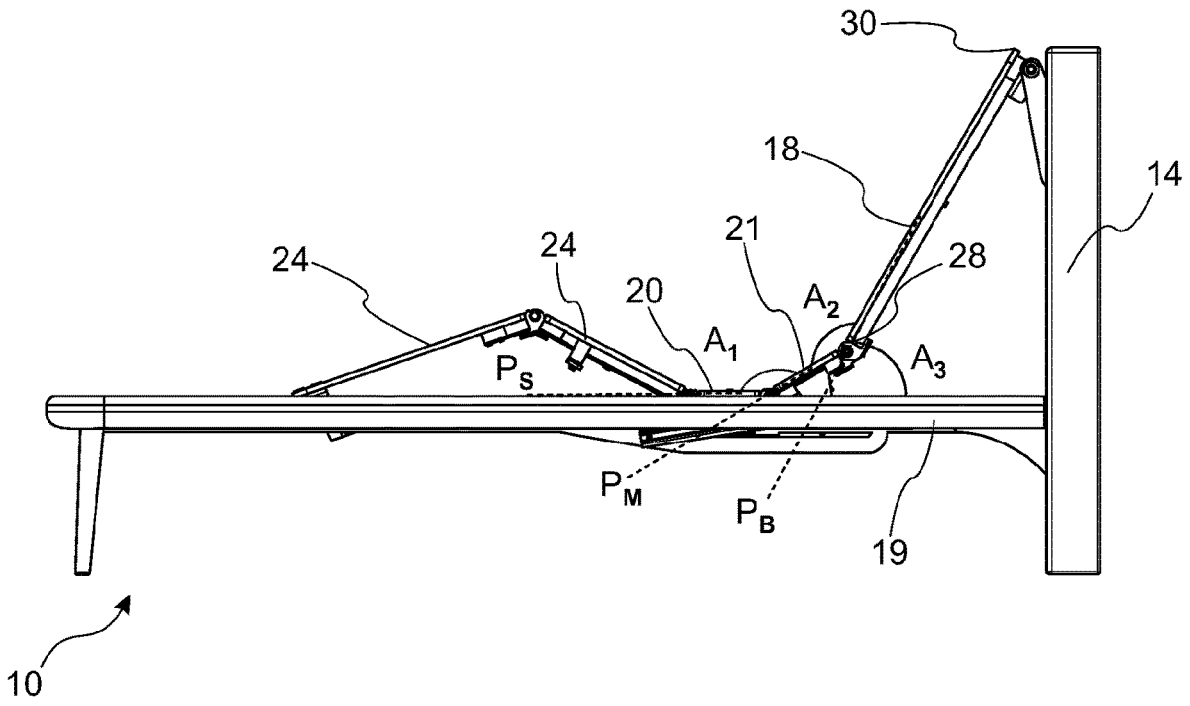
Figure 11:
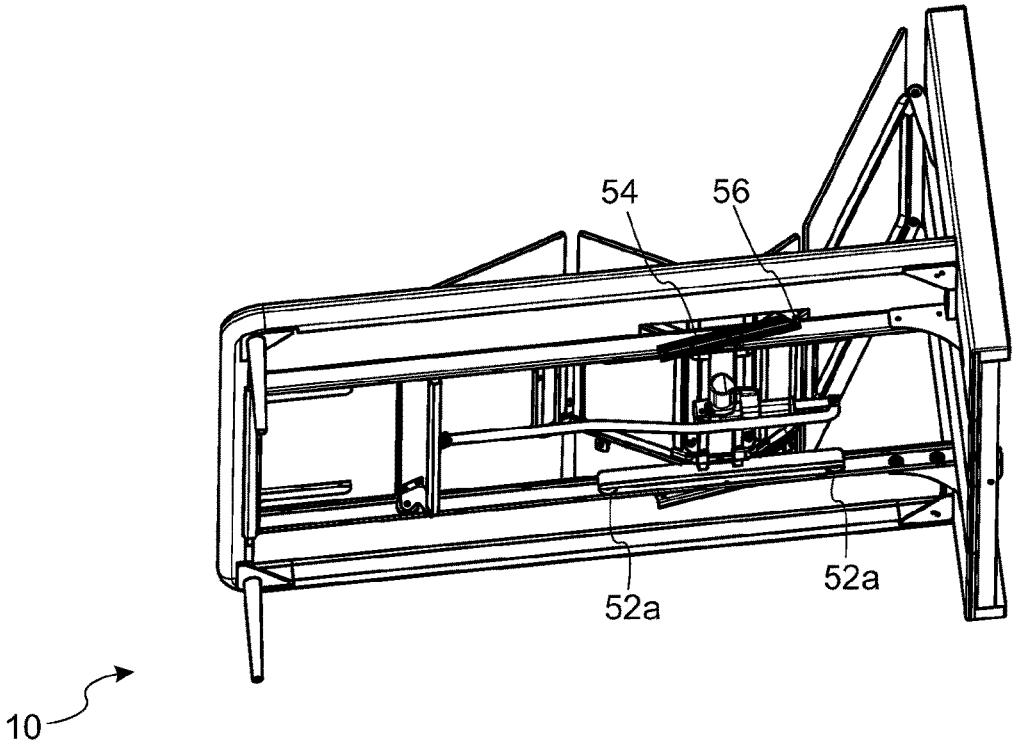
Figure 12:
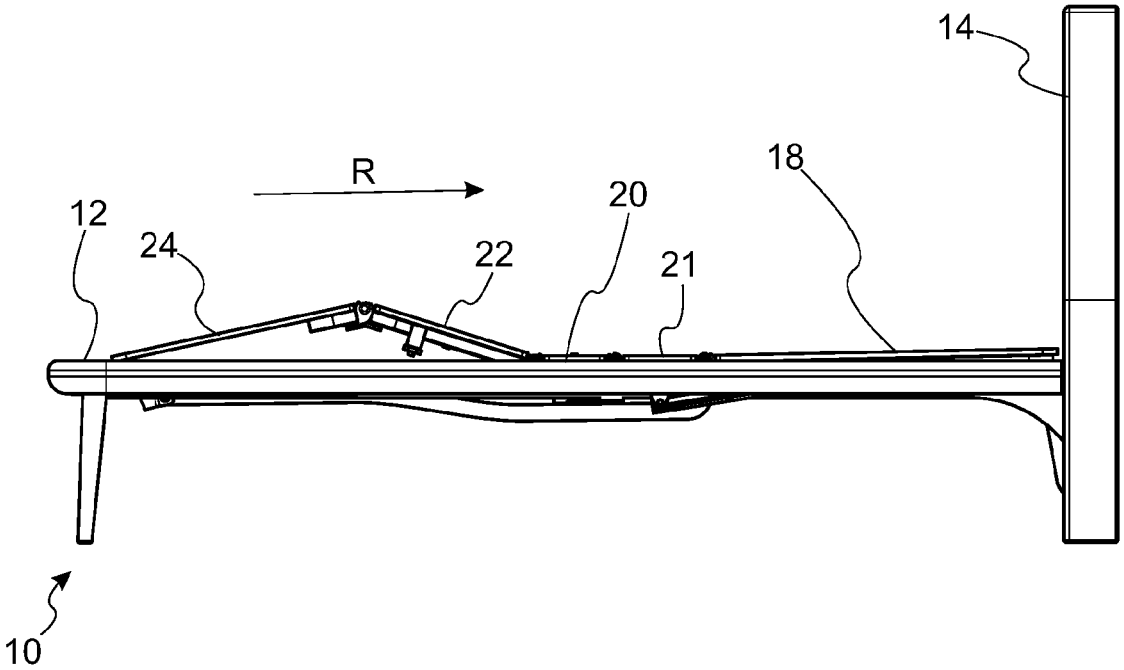
Figure 13:
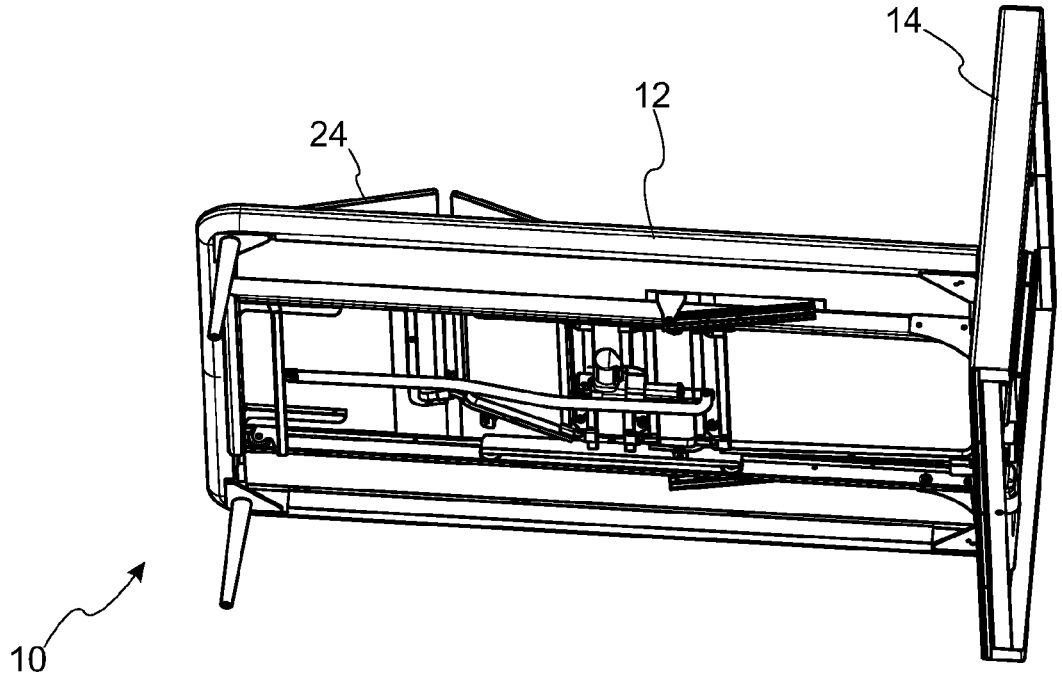
Figure 14:
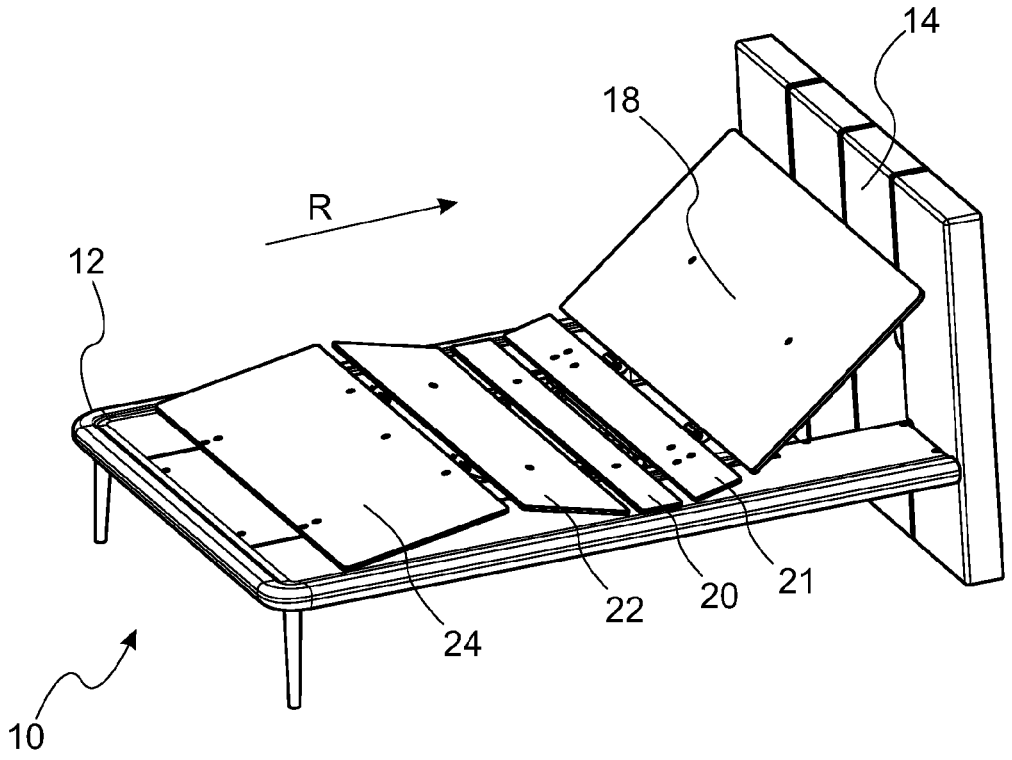
Figure 15:
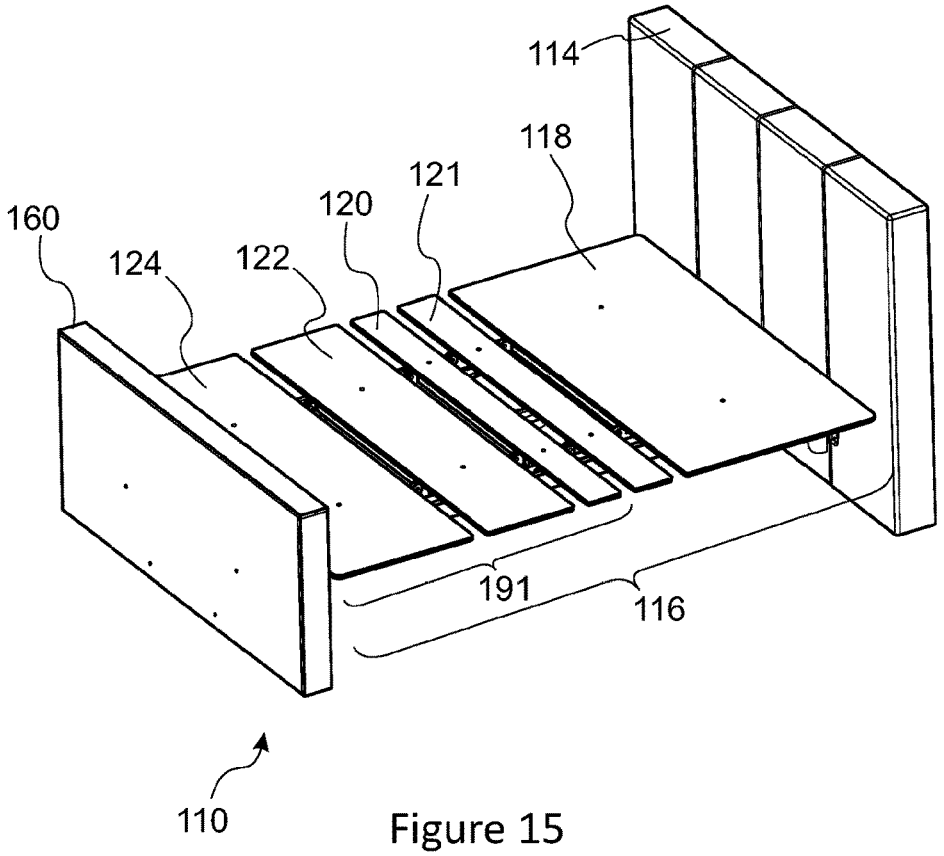
Figure 16:
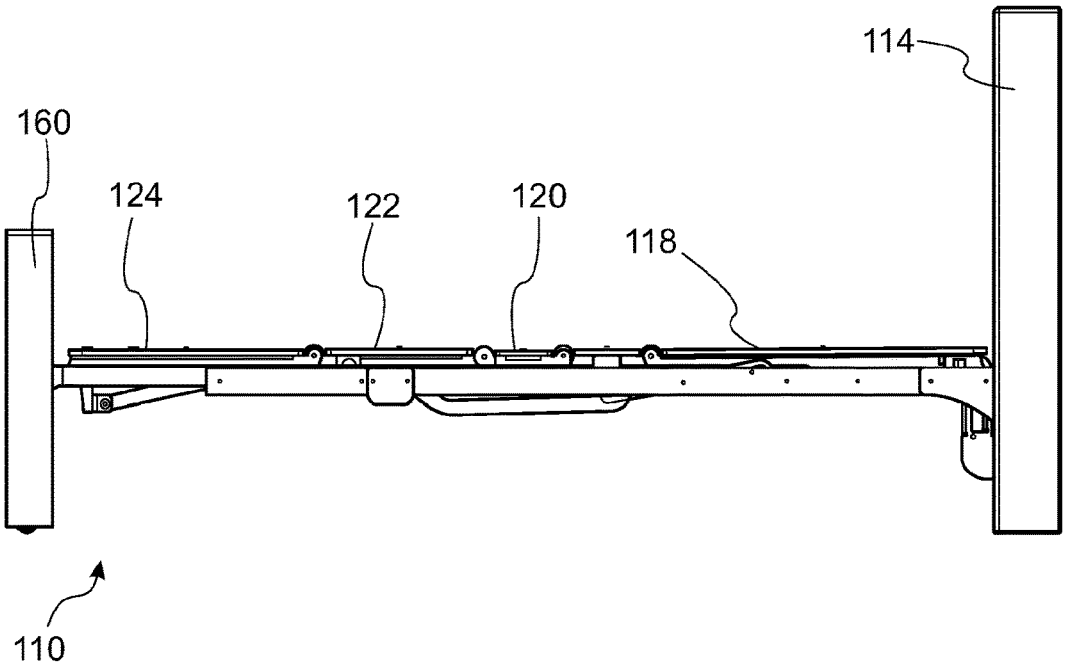
Figure 17:
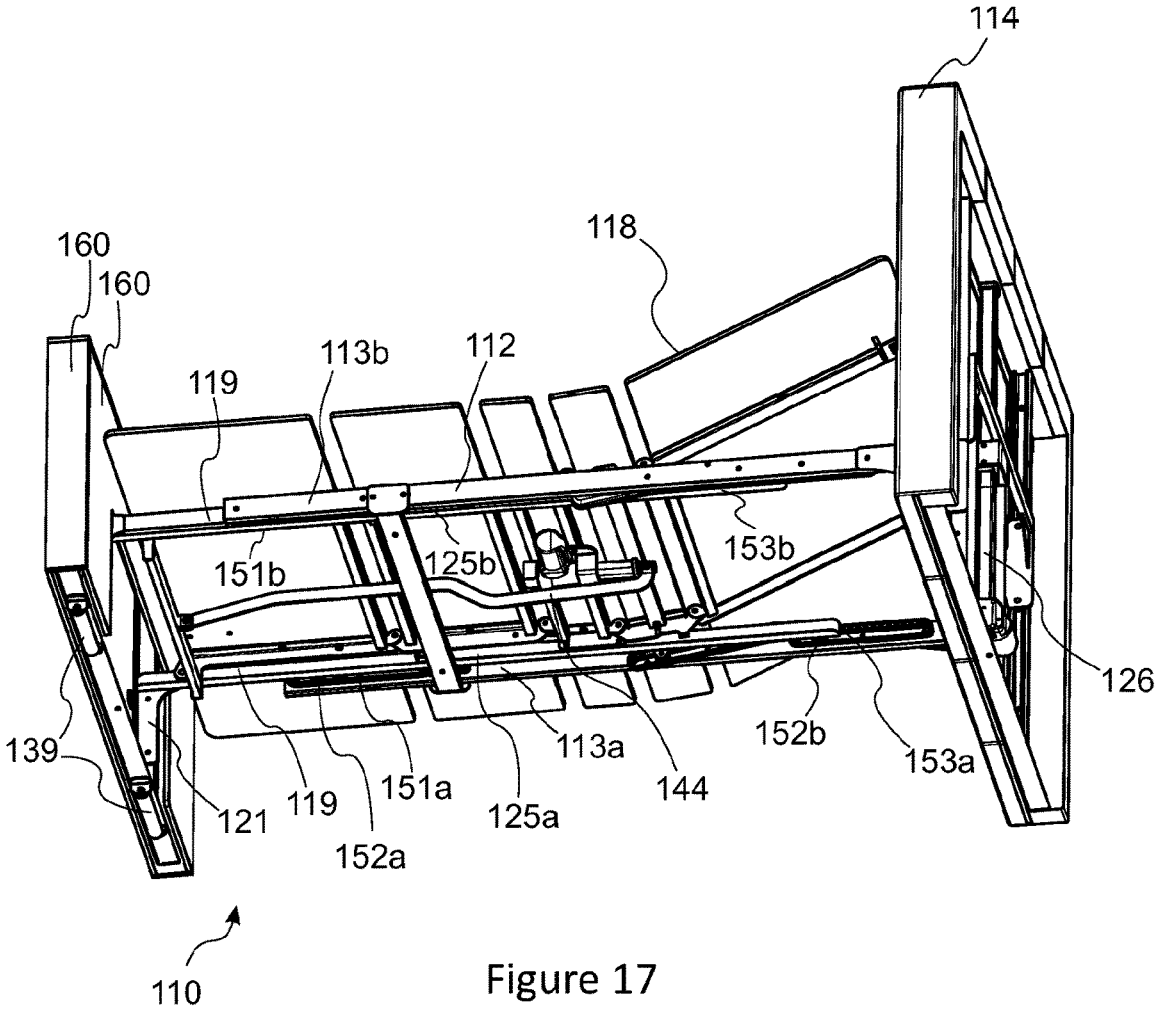
Figure 18:
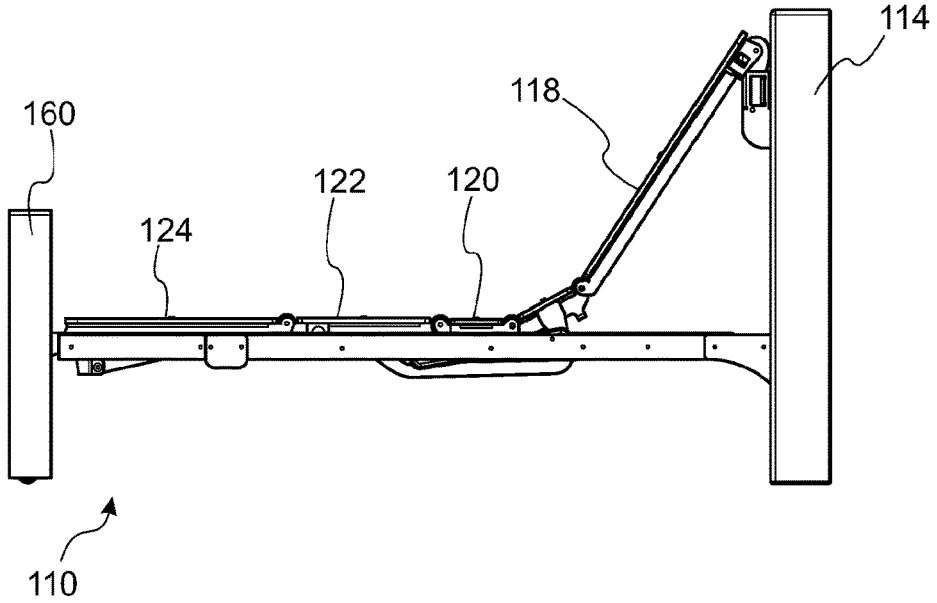
Figure 19:
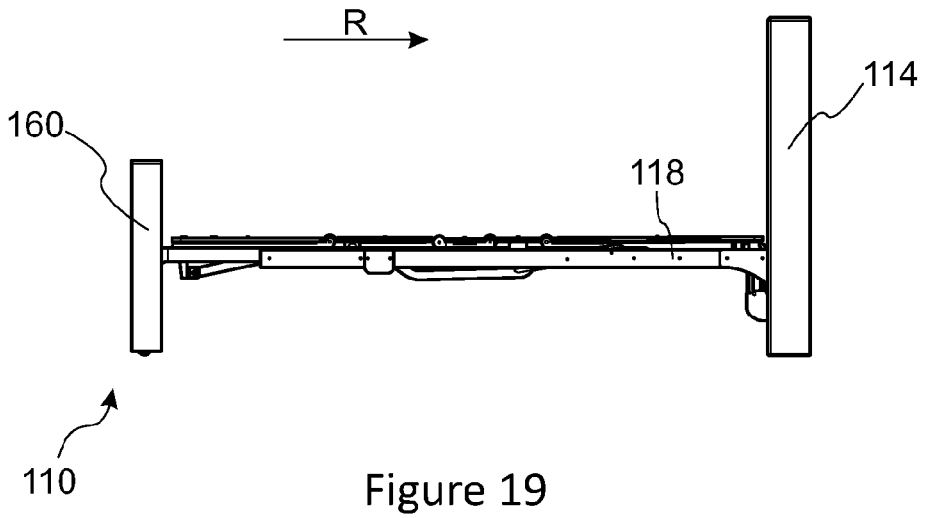
Figure 20:
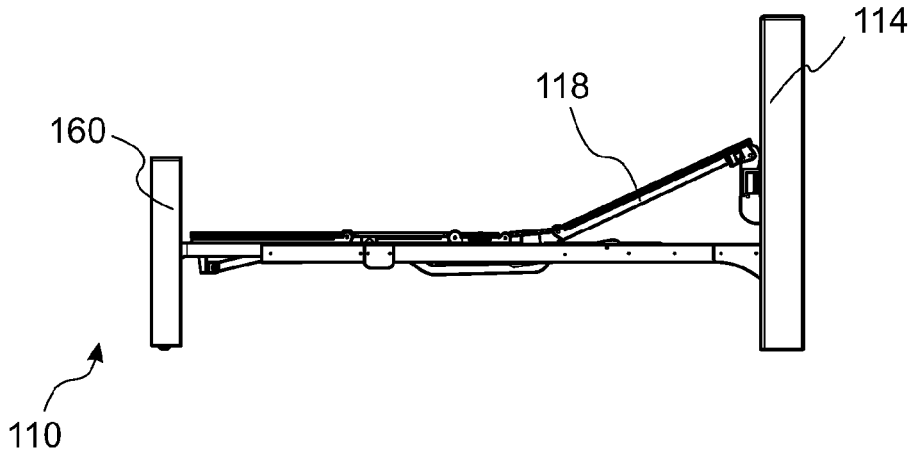
Figure 21:
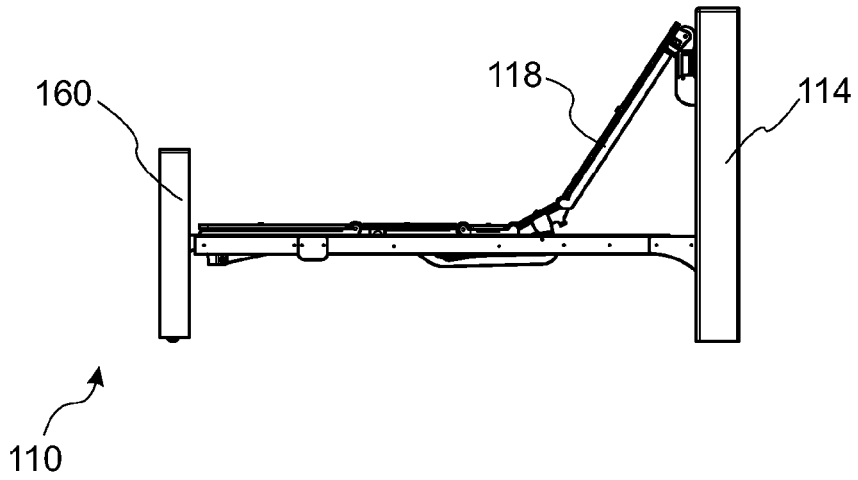
Figure 22:
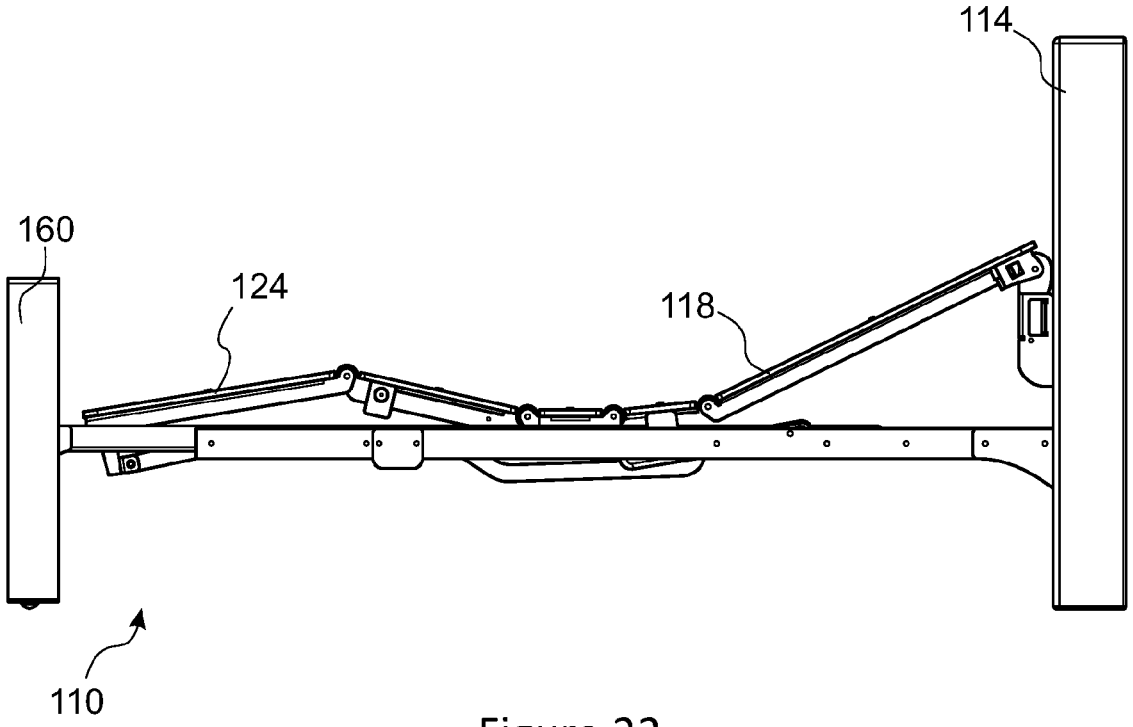
Figure 23:
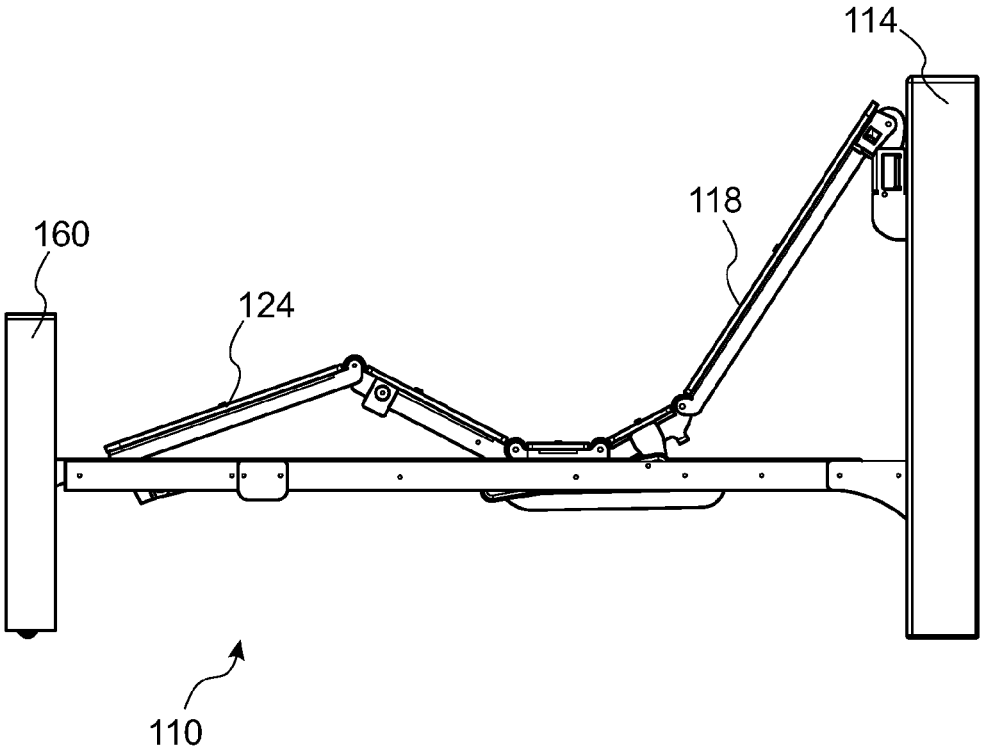
Figure 24:
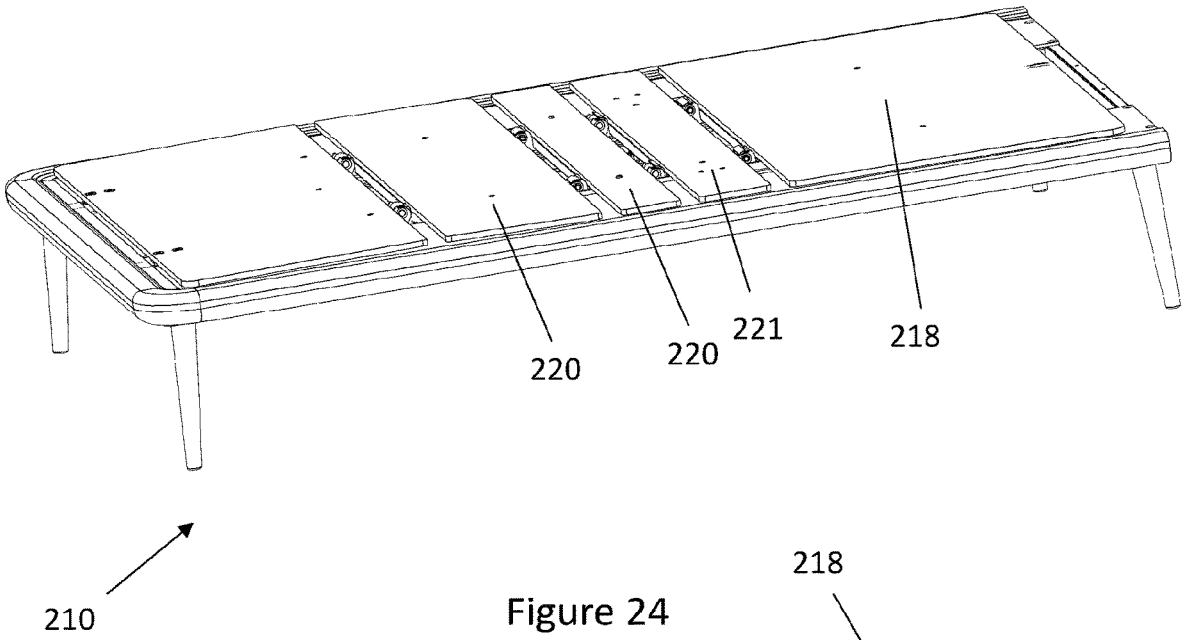
Figure 25:
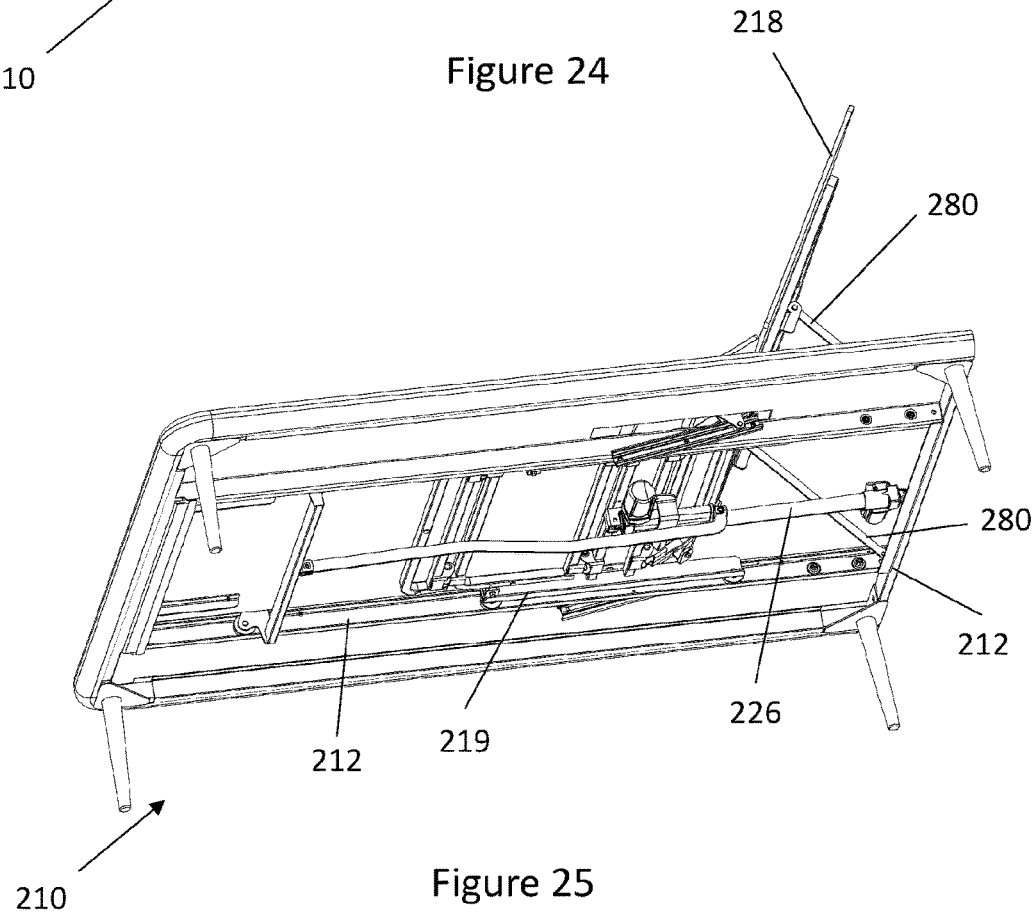
Figure 26:
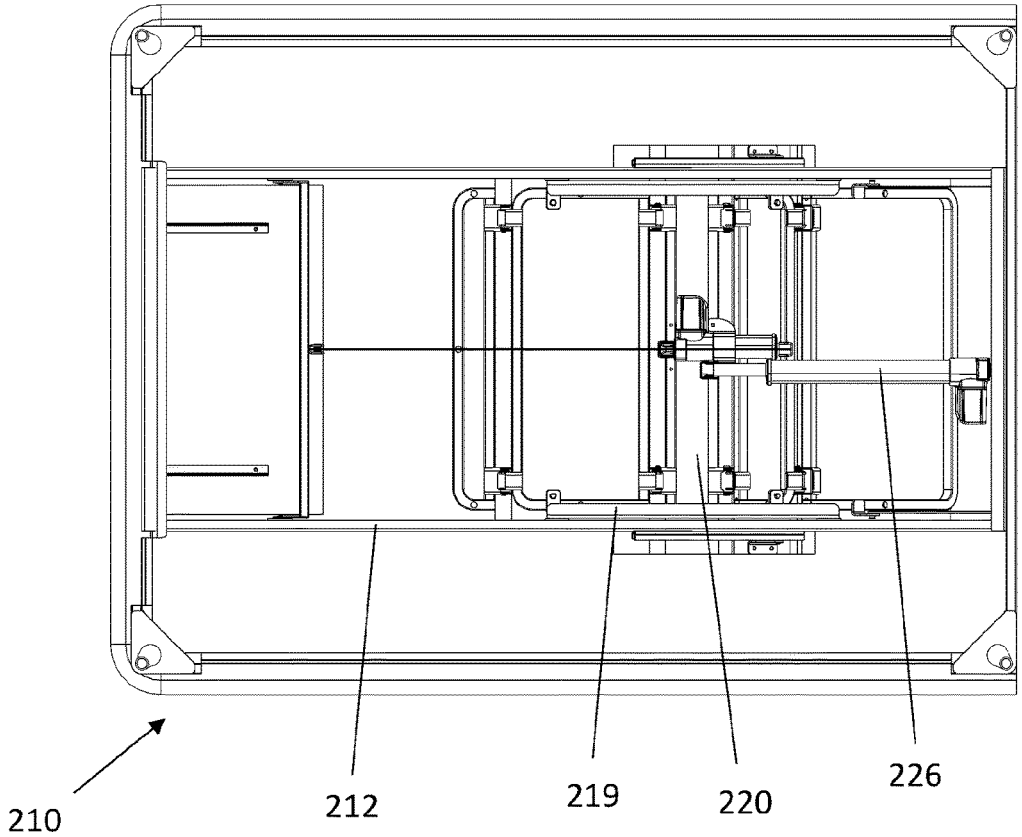
Figure 27:
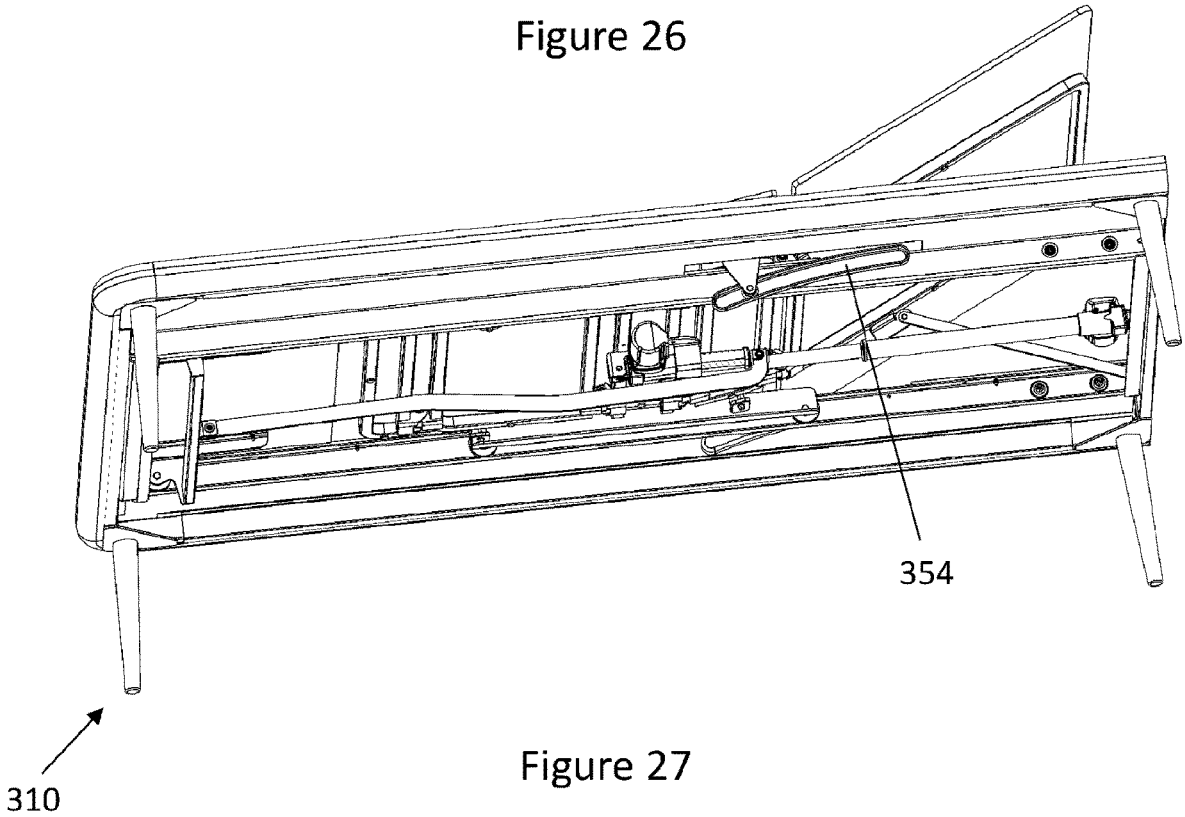
Figure 28:
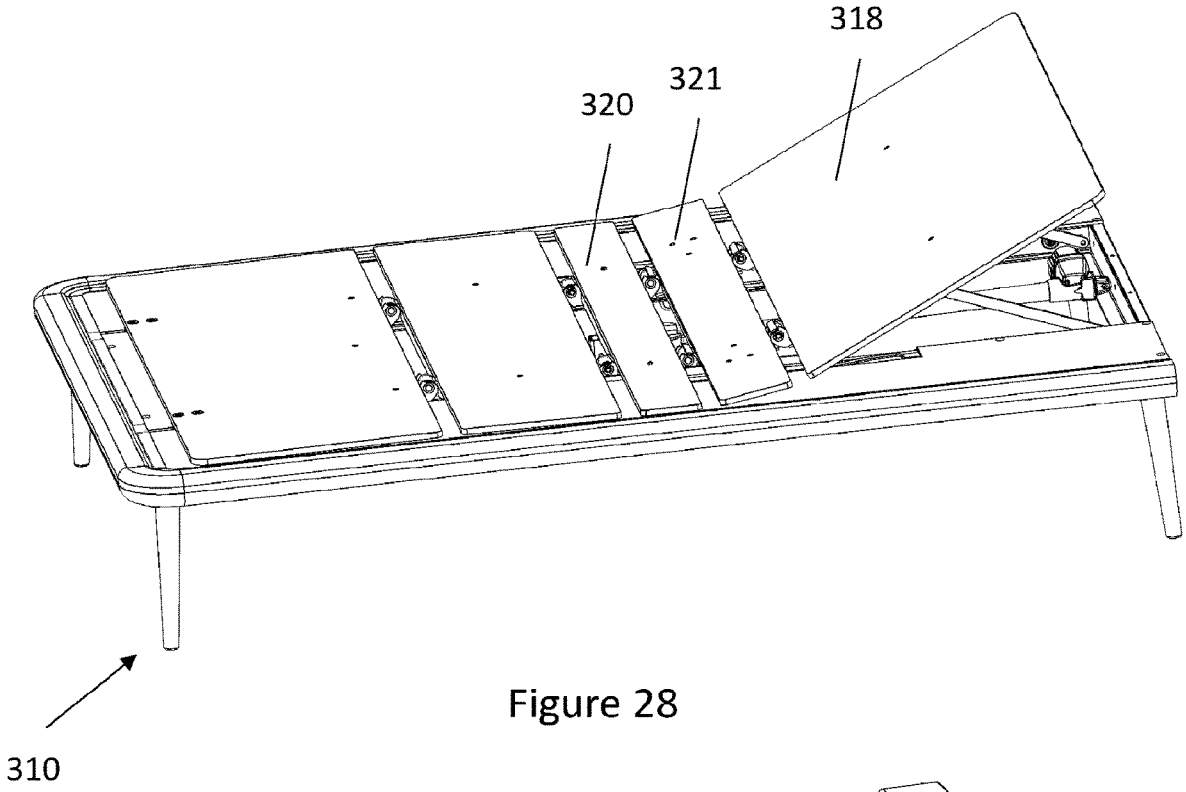
Figure 29:
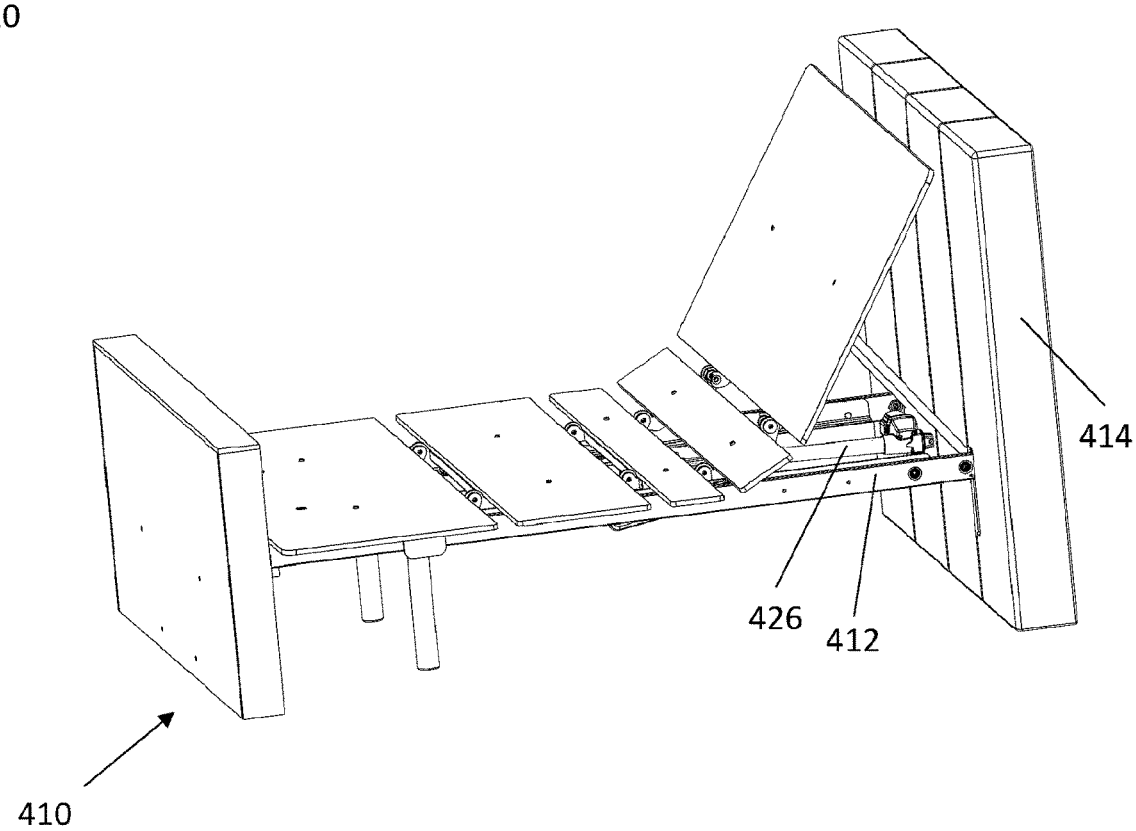
Figure 30:
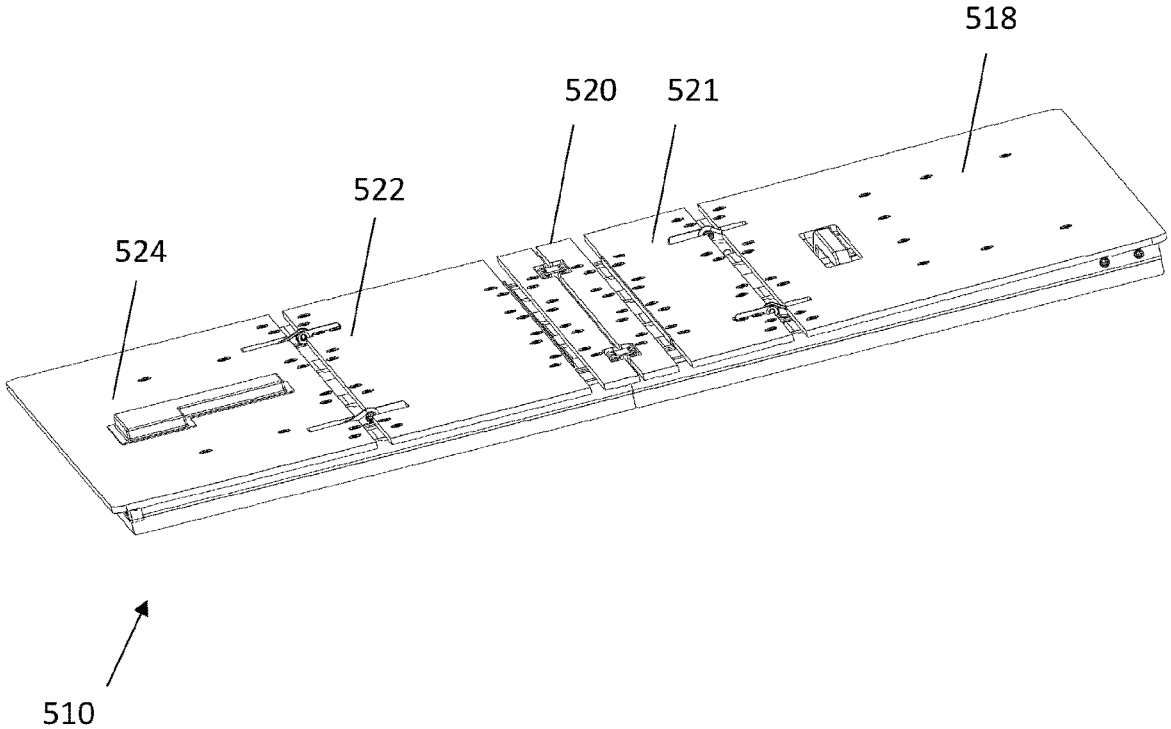
Figure 31:
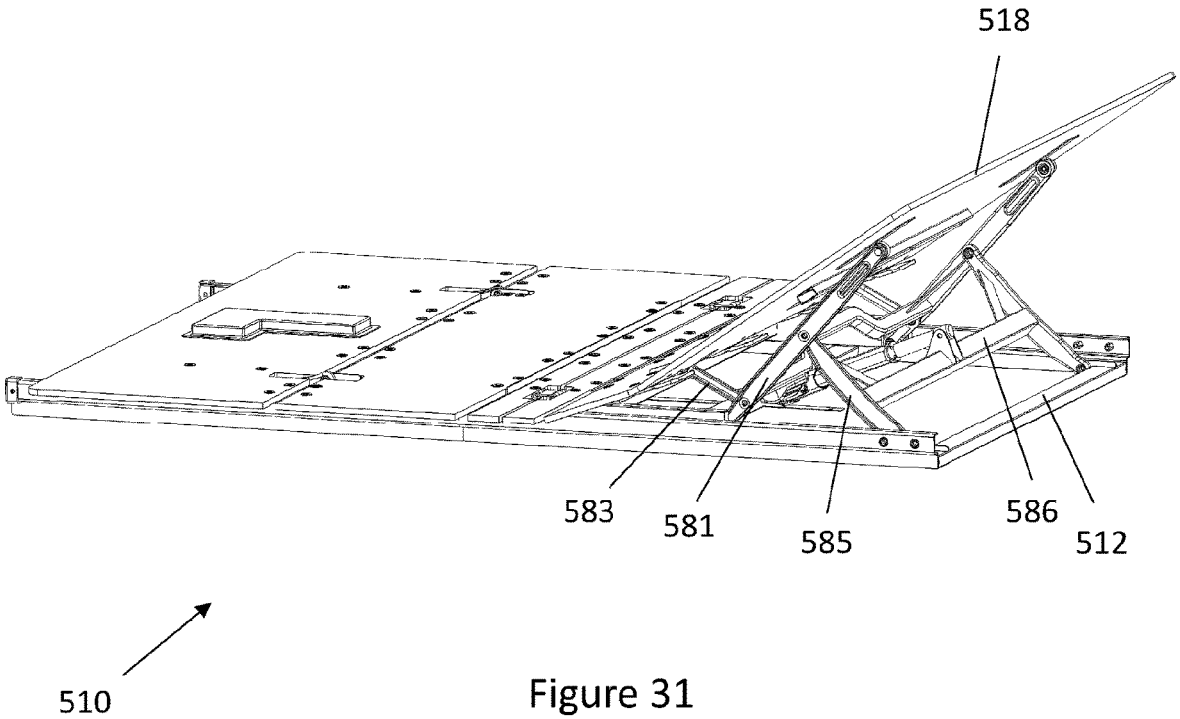
Figure 32:
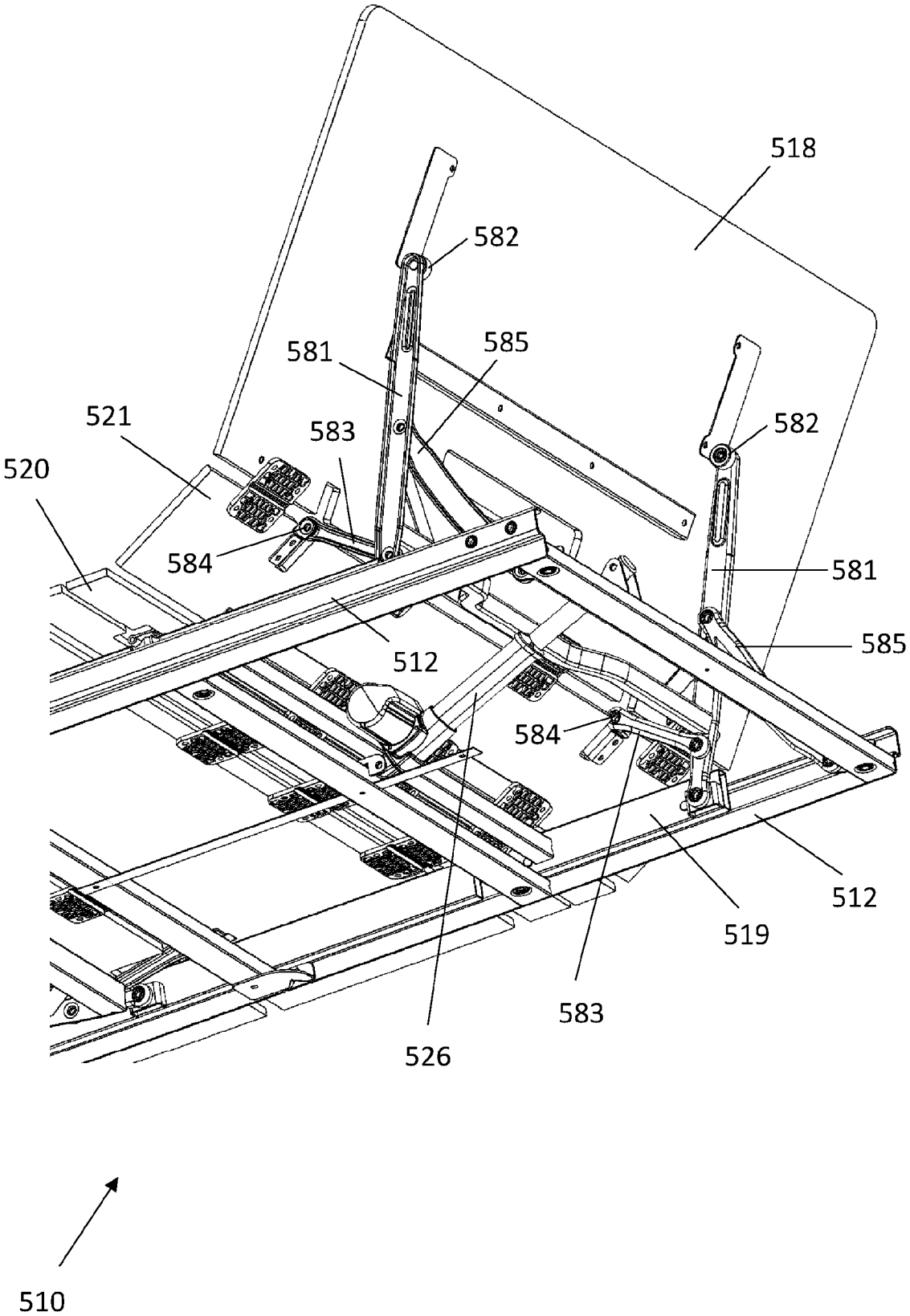
Figure 33:
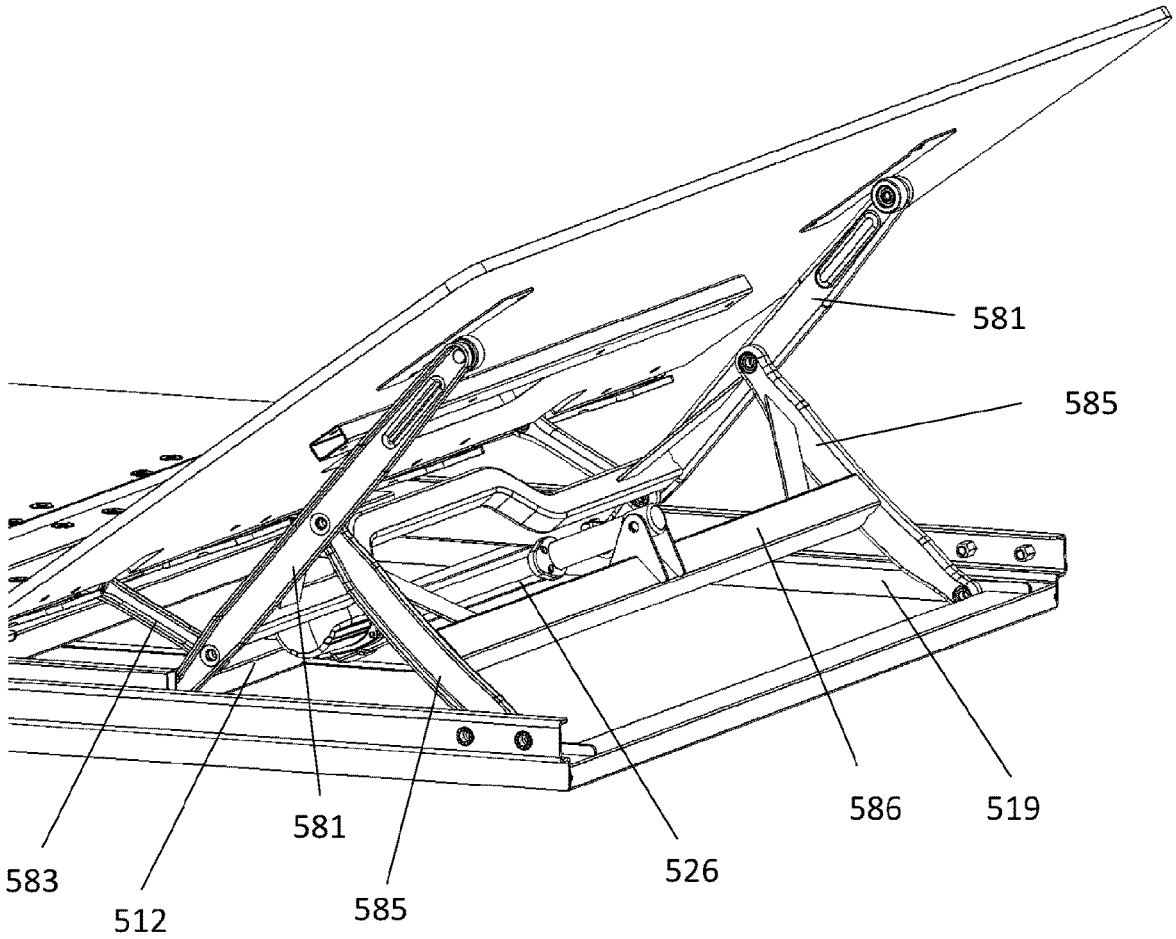
Figure 33:
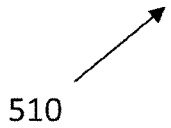
Figure 34:
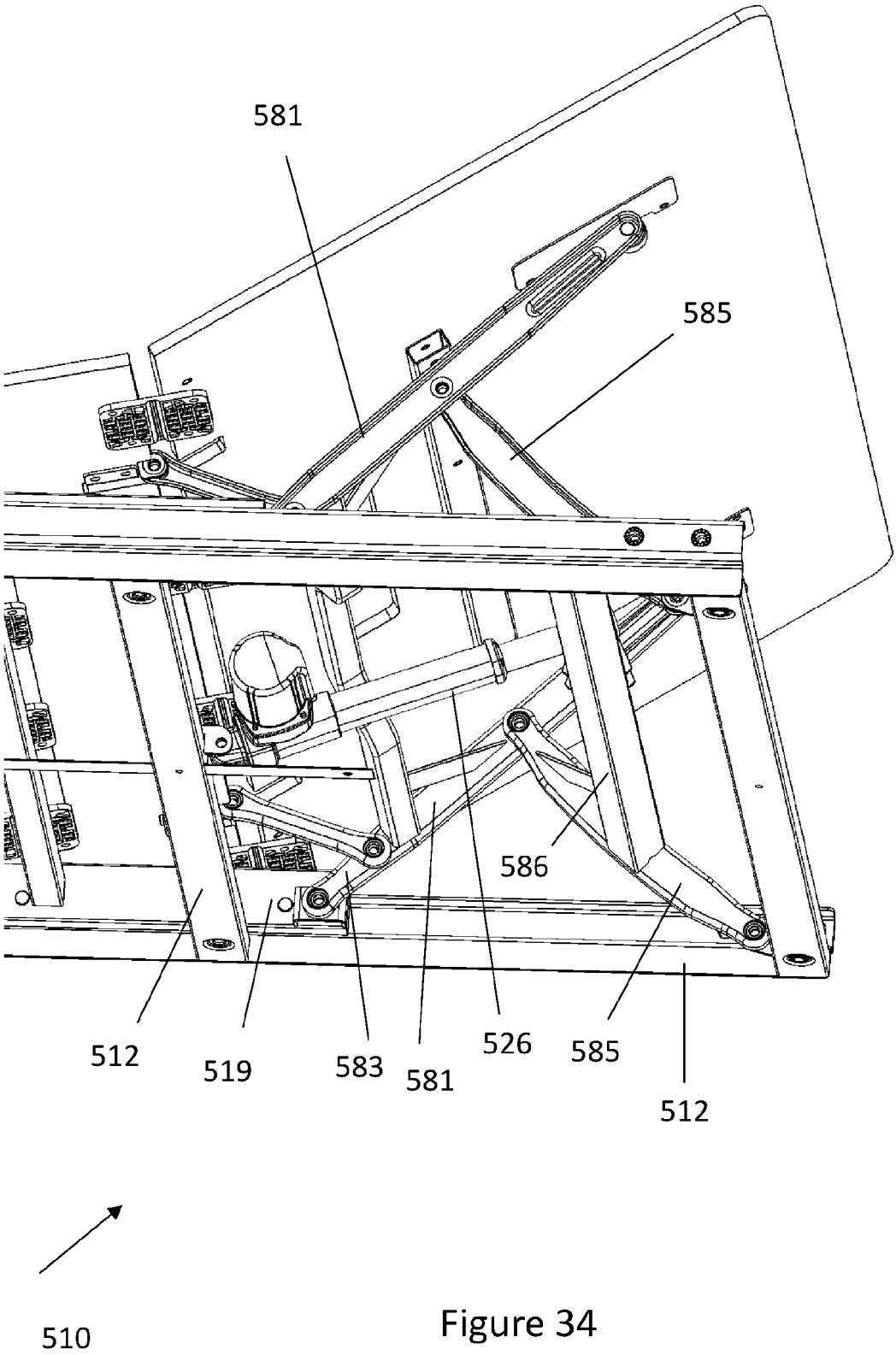
Figure 35:
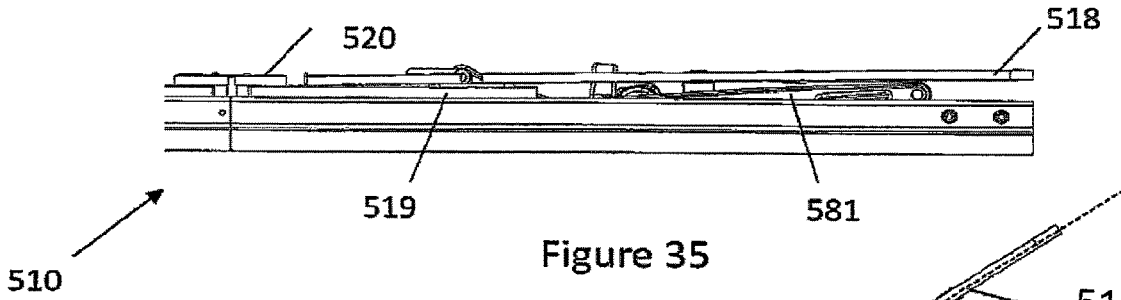
Figure 36:
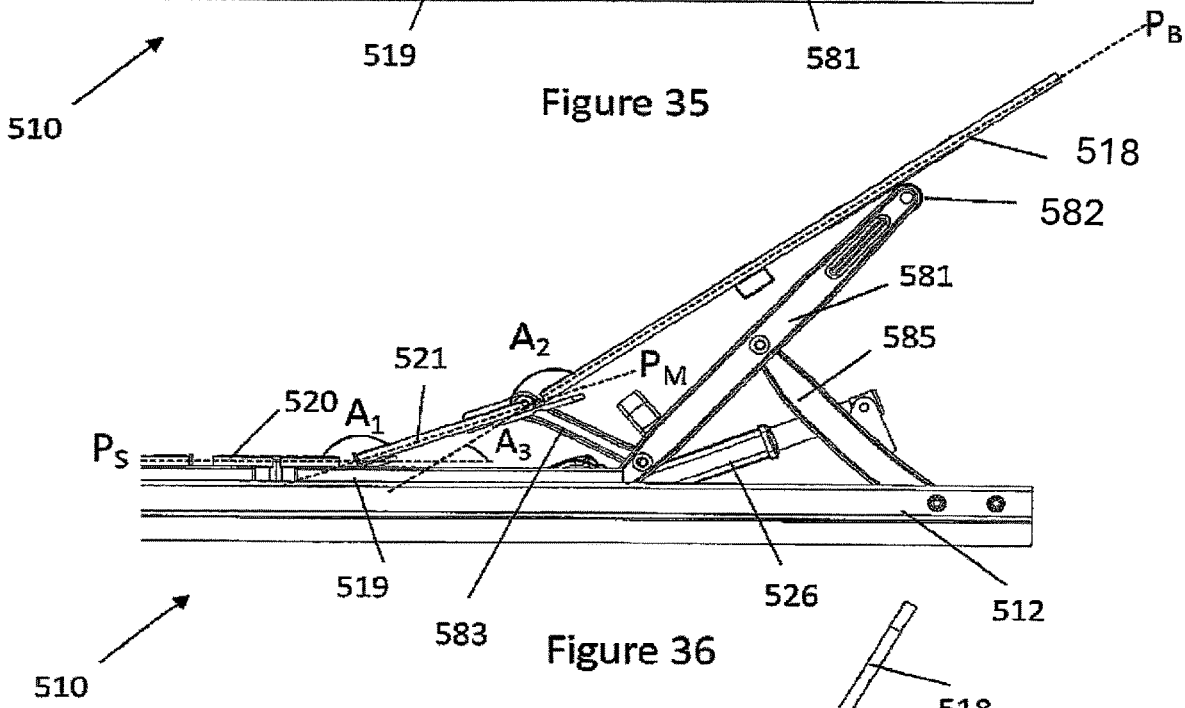
Figure 37:
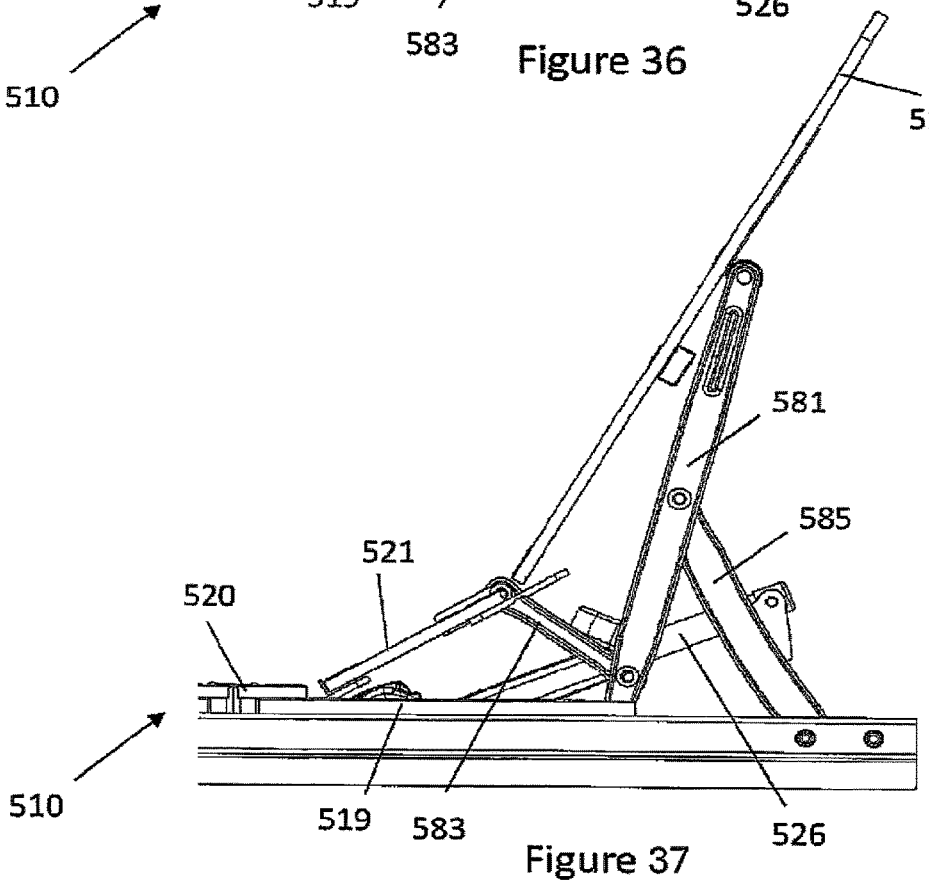
Figure 38:
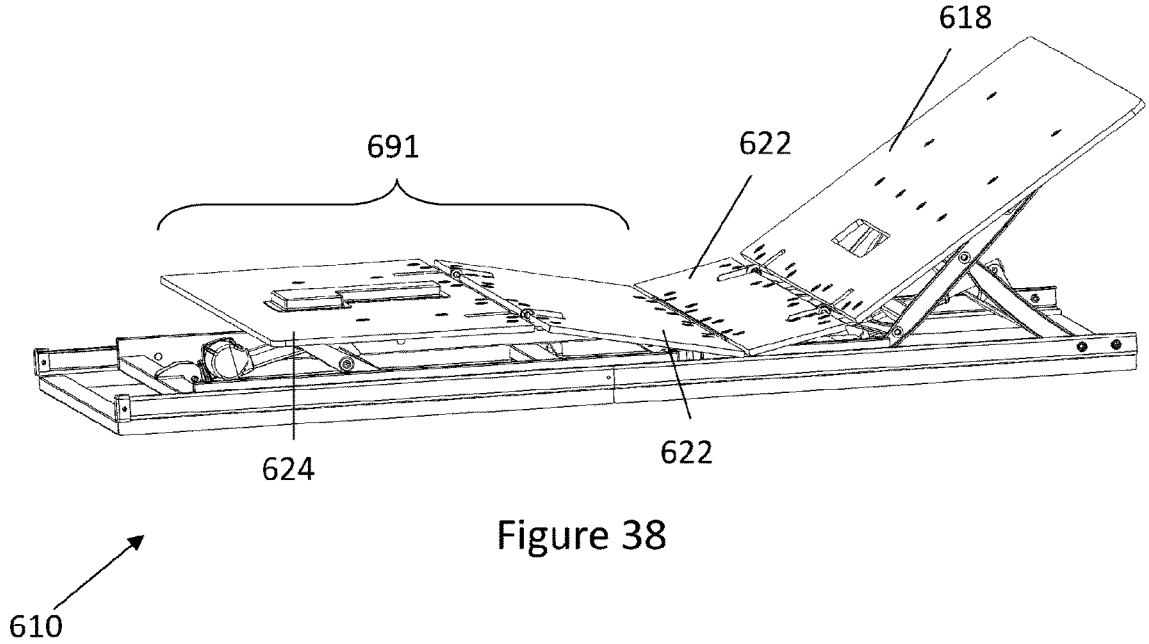
Figure 39:
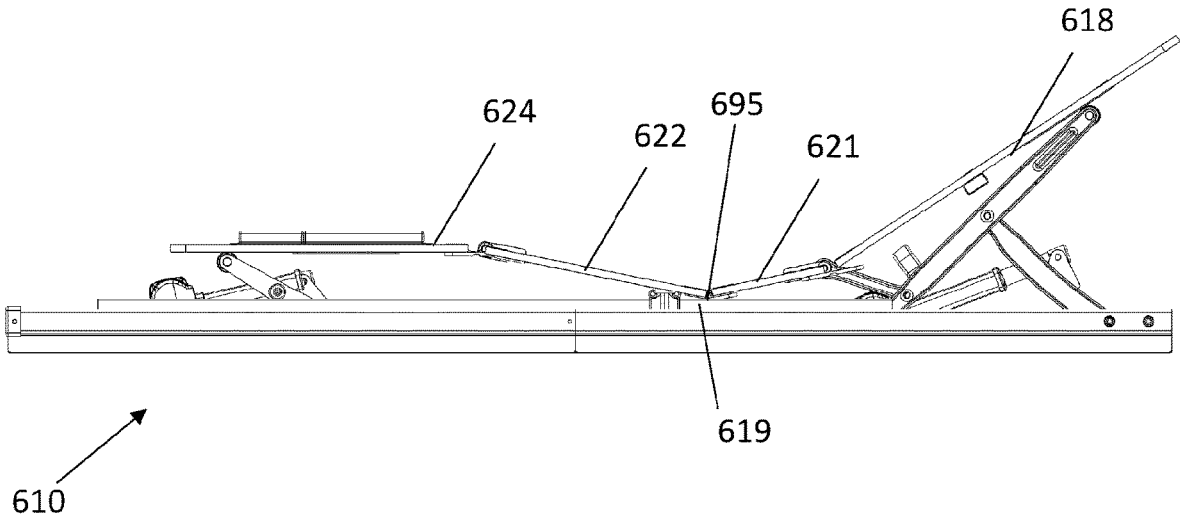

The invention will be now described by way of example only with reference to the accompanying drawings, in which:

FIGS. 1 to 3 are perspective views of an adjustable bed according to one aspect of the present invention with the back support platform in a flat lowered position and a foot support platform in a flat lowered position, FIGS. 4, 4*a* and 5 are perspective views of the adjustable bed of FIG. 1 with the back support platform in an intermediate position and the foot support platform in a flat lowered position, FIGS. 6 and 7 are perspective views of the adjustable bed of FIG. 1 with the back support platform in a raised position and the foot support platform in a flat lowered position, FIG. 8 is a side view of the adjustable bed of FIG. 1 with the back support platform in a raised position and the foot support platform in a raised position, FIG. 9 is a perspective view of the adjustable bed of FIG. 1 with the back support platform in a raised position and the foot support platform in a raised position, FIG. 10 is a side view of the adjustable bed of FIG. 1 with the back support platform in a raised position and the foot support platform in a raised position, FIG. 11 is a perspective view of the adjustable bed of FIG. 1 with the back support platform in a raised position and the foot support platform in a raised position, FIG. 12 is a side view of the adjustable bed of FIG. 1 with the back support platform in a flat lowered position and the foot support platform in an intermediate position, FIG. 13 is a perspective view of the adjustable bed of FIG. 1 with the back support platform in a flat lowered position and the foot support platform in an intermediate position, FIG. 14 is a perspective view of the adjustable bed of FIG. 1 with the back support platform in an intermediate position and the foot support platform in an intermediate position, FIG. 15 is a perspective view of an alternative adjustable bed with the back support platform in a flat lowered position, the foot support platform in a flat lowered position, and the footboard in a fully extended position, FIG. 16 is a side view of the bed of FIG. 15 with the back support platform in a flat lowered position, the foot support platform in a flat lowered position, and the footboard in a fully extended position, FIG. 17 is a perspective view of the bed of FIG. 15 with the back support platform in a fully raised position, the foot support platform in a flat lowered position, and the footboard in a fully retracted position, FIG. 18 is a side view of the bed of FIG. 15 with the back support platform in a fully raised position, the foot support platform in a flat lowered position, and the footboard in a fully retracted position, FIG. 19 is a side view of the bed of FIG. 15 with the back support platform in a flat lowered position, the foot support platform in a flat lowered position, and the footboard in a fully extended position, FIG. 20 is a side view of the bed of FIG. 15 with the back support platform in an intermediate position, the foot support platform in a flat lowered position, and the footboard in a partially retracted position, FIG. 21 is a side view of the bed of FIG. 15 with the back support platform in a fully raised position, the foot support platform in a flat lowered position, and the footboard in a fully retracted position, FIG. 22 is a side view of the bed of FIG. 15 with the back support platform in an intermediate position, the foot support platform in an intermediate position, and the footboard in a partially retracted position, FIG. 23 is a side view of the bed of FIG. 15 with the back support platform in a fully raised position, the foot support platform in a fully raised position, and the footboard in a fully retracted position, FIG. 24 is a perspective view of an alternative adjustable bed with the back support platform in a flat lowered position, FIG. 25 is a perspective view of the bed of FIG. 24 with the back support platform in a raised position, FIG. 26 is an underside plan view of the bed of FIG. 24 with the back support platform in a raised position, FIG. 27 is a perspective view of an alternative adjustable bed with the back support platform in an intermediate position between a flat lowered and raised position, FIG. 28 is a perspective view of the bed of FIG. 27 with the back support platform in an intermediate position between a flat lowered and raised position, FIG. 29 is a perspective view of an alternative adjustable bed with the back support platform in a raised position, FIG. 30 is a perspective view of an alternative adjustable bed with the back support platform in a flat lowered position, FIG. 31 is a perspective view of the bed of FIG. 30 with the back support platform in a raised position, FIG. 32 is a part perspective view of the bed of FIG. 30 with the back support platform in a raised position, FIG. 33 is a part perspective view of the bed of FIG. 30 with the back support platform in an intermediate position between a flat lowered and raised position, FIGS. 34 to 37 are side views of the bed of FIG. 30 with the back support platform in an flat lowered position, and intermediate position, and a fully raised position, FIG. 38 is a perspective view of an alternative adjustable bed with the back support platform in an intermediate position, and FIG. 39 is a side view of the bed of FIG. 38 with the back support platform in an intermediate position.

In FIGS. 1 to 14, an adjustable bed 10 comprises a base 12 and a headboard 14 which is slidably fixed relative to the base 12. The base 12 includes a pair of parallel-spaced side rails 13*a*, 13*b* which are fixed to an outer frame 15 of the base. The headboard 14 is fixed to the side rails 13*a*, 13*b*. The side rails 13*a*, 13*b* also define a support carriage guide in the form of support carriage grooves 50*a*,50*b*. The base 12 further includes legs 17 positioned at the opposite end of the bed 10 to the headboard 14.

The headboard 14 comprises a top 23*a* and bottom 23*b* substantially horizontal rail onto which a plurality of upright adjacent panels 90, in this embodiment, four panels 90*a,b,*

*c,d* are fixed. It can be seen that a slot 72 is created by a gap between adjacent panels 90*a* and 90*b*, and 90*c* and 90*d*, the purpose of which will be described below.

The adjacent panels 90 define a front face 32 of the headboard 18 which faces the back support platform 14, and a rear face 34 which is opposite the front face 32.

The bed 10 further comprises a support platform 16 in the form of a back support platform 18, a lower support platform 91 and a mattress bend support platform 21. The lower support platform 91 comprises a seat support platform 20, a thigh support platform 22 and a foot support platform 24. The mattress bend support platform 21 is provided between and adjacent to the back support platform 18 and the seat support platform 20. Each platform 18,20,21,22,24 is secured by a suitable fastening such as a screw, to an associated frame 18*a*,20*a*,21*a*,22*a*,24*a* (best seen in FIG. 6 where the support platforms 18,20,21,22,24 have been removed).

The back support platform 18 has a first end 28 which is adjacent the mattress bend support platform 21, and a second end 30 adjacent the headboard 14.

The foot support platform 24 includes an additional frame 25 which is connected to a second actuator 44 via a connecting pull bar 27.

The bed 10 includes a support carriage 19 onto which the seat support platform 20 is slidably and pivotally fixed such that it moves with support carriage 19 as will be described below. An alternative bed may not include a fixed seat support platform, with the support carriage slidably fixed to another part of the support platform, for example, a pivotal connection between the mattress bend support platform and the thigh support platform.

The support carriage 19 includes a pair of side brackets 25*a*,25*b* onto each of which is mounted a support carriage follower in the form of a pair of support carriage rollers 52*a*,52*b*. The support carriage rollers 52*a*,52*b* fit and are able to slide in support carriage grooves 50 to enable relative sliding movement between the support carriage 19 and the base 12 onto which the support carriage grooves 50 are fixed. It will be understood that the seat support platform 20, by virtue of being fixed to the support carriage 19, can slide relative to the base 12.

The foot support platform 24 further includes a foot support platform follower in the form of rollers 92 which fit in and can slide relative to support carriage grooves 50*a*, 50*b* fixed on the base 12. It will be understood that the foot support platform 24 can slide in the support carriage grooves 50*a*,50*b* as a result of actuation by the second actuator 44 via the connecting pull bar 27, or by movement of the support carriage 19 under operation of the first actuator 26. That is, the foot support platform 24 is slidable relative to the seat support platform 20 independently of relative movement between the support carriage 19 and the base 12.

Each platform 18,20,21,22,24 includes a pair of laterally spaced-apart hinges 21*a*,21*b*,21*c*,21*d* pivotally connecting each platform to the adjacent platform to allow relative pivotal movement between adjacent platforms.

The base 12 includes a mattress bend support platform guide in the form of pair of straight and inclined U-channelled grooves 54, each fixed to side rails 13*a*, 13*b* of the base 12.

A mattress bend support platform follower is provided in the form of rollers 56, each fixed to the mattress bend support platform 21 via a bracket 53 and slidable in the inclined U-channelled grooves 54 on the base 12. The U-channelled grooves 54 are inclined vertically upwards and rearwards towards the headboard 14 such that in the back support platform 18 raised position, the mattress bend support platform follower 56 is positioned vertically above the support platform follower 52*a,b* (FIG. 11).

Relative movement between the rollers 56 and the grooves 54 coordinates the movement of the mattress bend support platform 21 as the back support platform 18 moves between lowered and raised positions. In an alternative embodiment, the coordinated movement between adjacent platform to the mattress bend support platform 21, i.e. the seat support platform 21 and the back support platform 18, can be effected without the use of the guide 56 and follower 52 arrangement hereinbefore described. For example, in FIG. 6, hinge 21*d* can be a limiting hinge which controls the relative pivoting movement between the mattress bend support platform 21 and the back support platform 18 and hinge 21*c* can be a limiting hinge which controls the relative pivoting movement between the mattress bend support platform 21 and the seat support platform 20.

The bed 10 includes a first actuator 26 having a main body 29 which is mounted on the top 23*a* and bottom 23*b* rail of the headboard 14. A sliding block 31 is slidably mounted for movement within the main body 29 of the first actuator 26. It will be understood therefore that the first actuator 26 is mounted on the rear face 34 of the headboard 14, albeit indirectly via the top and bottom rails 23*a*,23*b* which are mounted directed on the headboard panels 90. In an alternative embodiment, the first actuator 26 can be mounted directly on the headboard panels 90. The first actuator in this embodiment is a motorised linear actuator. In alternative embodiments, the first actuator can be a gas strut.

The bed 10 includes connecting means in the form of an actuator connecting means in the form of a substantially horizontal actuator cross member 78, and a back support platform connecting means in the form of a pair of spaced apart actuator side brackets 80 which are fixed at each end of the actuator cross member 78. The actuator side brackets 80 are pivotally connected to the back support platform 18 via fixed brackets 79. The sliding block 31 is fixed to the horizontal actuator cross member 78 such that movement of the first actuator 26 moves the horizontal actuator cross member 78.

It can be seen in FIGS. 1 to 4 that each actuator side bracket 80 extends through the slots 72 and can move vertically under operation of the actuator 26 as will be described below.

It can also be seen that the first actuator 26 is pivotally connected to the back support platform 18 via the connecting means in the form of the horizontal actuator cross member 78, the actuator side brackets 80 and the fixed brackets 79, and at the second end 30 of the back support platform 18 which is adjacent and proximate to the headboard 14. Whilst the first actuator 26 operates most efficiently when the pivotal connection is at or proximate the second 30 of the back support platform 18, it is still advantageous from an actuator efficiency perspective to position the pivotal connection closer to the second end 30 than to the first end 28.

The bed 10 includes a track assembly in the form of a pair of U-channelled track components 76 mounted on the rear face 34 of the headboard 14. A pair of rollers (not shown) on each actuator side bracket 80 fit and slide within the U-channelled track components 76 to enable relative guided vertical sliding movement therebetween.

It can be seen in FIGS. 4 and 4*a* that the connecting means 78,80 drivingly connects the first actuator 26 to the back support platform 18 as will be described below.

It can be seen in FIGS. 3 and 4 that a longitudinal axis L of the actuator body 29 is substantially perpendicular to an upper surface 36 of the back support platform 18 when the back support platform 18 is in a lowered or flat position. It can further be seen the actuator body is substantially vertical. In alternative embodiments, the actuator can be arranged horizontally or inclined on the headboard providing suitable gearing is provided between the actuator and the actuator side brackets 80 to enable the actuator side brackets 80 to move vertically and move the back support platform 18 between lowered and raised positions.

It can also be seen in FIG. 3 that the actuator 26 is not only mounted on the rear face 34 of the headboard 14, but is substantially contained within an envelope defined by front face 32 of the headboard 14 and a rearmost surface 38 of the headboard 14. This is important aesthetically and functionally as it enables the actuator 26 to be concealed if an additional rear panel (not shown) is added to the headboard or if the headboard is positioned against a wall (not shown).

Operation of the adjustable bed 10 is as follows:

In FIGS. 1 to 3, the bed 10 is shown with the foot support platform 24 in a flat lowered position and the back support platform 18 in a flat lowered position.

Actuation of the actuator 26 in an upwards direction causes sliding block 31 to slide vertically upwards and slide the horizontal actuator cross member 78 vertically upwards, the horizontal actuator cross member 78 being guided in the U-channelled track components 76.

As the horizontal actuator cross member 78 slides vertically upwards, the actuator side brackets 80 which are fixed to the horizontal actuator cross member 78, and are pivotally connected to the back support platform 18, cause the back support platform 18 to move from the lowered position of FIGS. 1 to 3 to an intermediate position shown in FIGS. 4 and 5. It can be seen from the comparison of FIGS. 1 and 5 that as the back support platform 18 is raised, the support carriage 19 and the support platform 16 which is fixed to the support carriage 19 is simultaneously pulled rearwards in the direction of arrow R towards the headboard 14.

Activation of the actuator 26 in a reverse downwards direction moves the back support platform 18 towards the lowered flat position and simultaneously pushes the support platform 16 away from the headboard in a direction opposite to arrow R (FIGS. 1 to 3).

It will be understood the movement of the support platform 16 enables a user or occupier sat or lying on the bed to maintain position relative to furniture such as a bedside cabinet (not shown) as the back support platform 18 is raised and lowered. Such functionality is called zero-wall functionality, alternatively referred to as a wall hugger bed or wall proximity bed.

Further activation of the actuator 26 in the upwards direction causes the back support platform 18 to move from the intermediate position of FIGS. 4 and 5 to the raised position of FIGS. 6 and 7 where it can be seen that the support carriage 19 and the support platform 16 which is fixed to the support carriage 19 is simultaneously pulled further rearwards in the direction of arrow R towards the headboard 14.

During movement of the back support platform 18 between the lowered and raised positions, relative movement between the rollers 56 and the grooves 54 coordinates the movement of the mattress bend support platform 21 relative to the seat support platform 20 and the back support platform 18 as the back support platform 18 moves between lowered and raised positions. With reference to FIG. 10, it can be seen that an angle $A_3$ is defined between a plane Ps defined by the seat support platform 20 and a plane $P_B$ defined by the back support platform 18. In this embodiment, the maximum inclined angle $A_3$ of the back support panel 18 with respect to the seat support platform 20 in the raised position is 70 degrees. This maximum inclined angle $A_3$ can be less, for example, a maximum of 65, 60, 55, 50 degrees or less.

Importantly, the effect of this maximum inclined angle $A_3$ on the bed, a mattress (not shown) for use on the bed (and supported by the support platform) and an occupant of the bed, can be mitigated with the provision of the mattress bend support platform 21, and specifically ensuring that a first angle $A_1$ defined between the plane Ps of the seat support platform 20 and a plane $P_M$ defined by the mattress bend support platform 21, and a second angle $A_2$ defined between the plane $P_M$ of the mattress bend support platform 21 and the plane $P_B$ of the back support platform 18 are maintained substantially equal as the back support platform 18 moves in both directions between the lowered and raised positions.

In an alternative embodiment, the difference between the first angle $A_1$ and the second angle $A_2$ is maintained at less than 10 degrees as the back support platform 18 moves between lowered and raised positions.

It is the provision of the straight grooves 54 which co-ordinates the pivotal movement between the mattress bend support platform 21 and seat support platform 20 and the mattress bend support platform 21 and the back support platform 18 as the back support platform 18 moves between the lowered and raised positions, and ensures that the first angle $A_1$ and the second angle $A_2$ are substantially equal or at the very least are different by less than 10 degrees.

In addition to movement of the back support platform 18 between raised and lowered position by the first actuator 26, and the corresponding simultaneous movement of the support carriage 19 together with the support platform 16, the second actuator 44 can slide the foot support platform 24 forwards towards and rearwards away from the headboard 14 independently of the movement of the support carriage 19.

In FIGS. 8 to 11, it can be seen that the second actuator 44 has pulled the foot support platform 24 rearwards towards the headboard 14. As the foot support platform 24 slides rearwards it pivots upwards. At the same time, the thigh support platform 22 also pivots upwards. Both the foot support platform 24 and the thigh support platform 22 pivot upwards when the actuator 44 is retracted towards the headboard 14 and pulls directly on the additional frame 25 of the foot support platform 24 via the connecting pull bar 27 by virtue of the thigh support platform 22 being hingedly connected to the seat support platform 20 onto which the second actuator 44 is fixed and the foot support platform 24 being hingedly connected to the thigh support platform 22.

It can be seen in a comparison of FIGS. 8 to 11 with the foot support platform 24 in a raised position, and FIGS. 6 and 7 with the foot support platform in a lowered flat position, that the back support platform 18 can be either raised or lowered, or anywhere in between the raised or lowered positions, irrespective and independently of the position of the foot support platform 24. That is, the back support platform 18 can be in the raised, lowered are any intermediate position, and in any of those positions, the foot support platform 24 can be raised, lowered are any intermediate position.

By way of further example, FIGS. 12 and 13 show the bed 10 with the back support platform 18 in a flat lowered position and the foot support platform 24 in an intermediate position, and FIG. 14 shows the bed with the back support platform 18 in an intermediate position and the foot support platform 24 in an intermediate position. It will be appreciated that the bed pf FIGS. 1 to 14 is a zero-wall bed, that is, raising the back support platform pulls the support carriage, and therefore the seat support platform mounted thereon rearwards towards the headboard.

FIGS. 15 to 23 show an alternative adjustable bed 110 which is identical to that in FIGS. 1 to 15 other than the differences identified below.

The bed 110 includes a moveable footboard 160 which slidably moves relative to the base 112 as the support carriage 119 moves relative to the base 112. The side brackets 125*a*, 125*b* are extended so as to fixably connect the support carriage 119 to the footboard 160. The footboard 160 includes wheels 139 to enable the footboard 160 to slide on the surface upon which the bed 110 is standing.

Single support carriage grooves 50*a*,50*b* on each side rail 113*a*, 113*b* of the base 112 are replaced by two support carriage cams in the form of grooves 151*a*, 151*b* which are fixed on each guide side rail 113*a*, 113*b* of the base 112. Followers in the form of rollers 152*a* and 152*b* are fixed to the support carriage 119 and slide in the respective support carriage grooves 151*a*, 153*a* and 151*b* and 153*b* instead of single support carriage grooves 50*a*,50*b* on each side rail 113*a*, 113*b* as the support carriage 119 slides relative to the base 112.

Operation of the bed 110 is identical to the operation of bed 10 except that that as the support carriage 119 slides relative to the base 112 under operation of the first actuator 126, side brackets 125*a*, 125*b* also move relative to the base 112, which by virtue of being fixed to the footboard 160, move the footboard 160 relative to the base 112.

Operation of the first actuator 126 moves the back support platform 118 between a lowered position (FIGS. 15, 16 and 19) towards an intermediate position (FIGS. 17 and 20) and a raised position (FIGS. 18 and 21).

It can be seen by comparing FIGS. 19, 20 and 21, that as the back support platform 118 moves from the lowered flat position to the raised position, the footboard 160 is pulled towards the headboard 114 in the direction of arrow R by virtue of the back support platform 118 pulling support carriage 119 which is fixably connected to the footboard 160.

In FIG. 19, the back support platform 118 is in the flat lowered position with the footboard 160 in fully extended position.

In FIG. 20, the back support platform 118 is in the intermediate position with the footboard 160 in a partially retracted position.

In FIG. 21 the back support platform 118 is in the fully raised position with the footboard 160 in a fully retracted position.

FIG. 22 shows the back support platform 118 is in the intermediate position with the footboard 160 in a partially retracted position, and the foot support platform 118 in an intermediate position between a lowered and fully raised position.

FIG. 23 shows the back support platform 118 is in the fully raised position with the footboard 160 in a fully retracted position, and the foot support platform 124 in a fully raised position.

It will be understood that in bed 110, the back support platform 118 can be in the raised, lowered are any intermediate position, with the footboard 160 in a corresponding extended, partially retracted and fully retracted positions, and as in the bed 10 of FIGS. 1 to 14, in any of those back support platform positions, the foot support platform 124 can be raised, lowered and any intermediate position.

It will also be understood that whilst in the embodiment of FIGS. 15 to 23 it is the back support platform 118 being raised and lowered by the first actuator 126 which pulls the footboard 160 rearwards, in an alternative embodiment, direct actuation of the footboard itself or the support carriage can pull in the footboard, causing the back support platform to be raised by virtue of being hingedly connected directly or indirectly to the support carriage upon which the seat support platform 20 is fixed. In other words, any relative movement between the base and the support carriage under the operation of an actuator causes the footboard to move relative to the base.

In a further embodiment, movement of the first actuator can cause a further component (not shown) to move between a first and second position. For example, the further component is a display screen such as a television or projector screen (not shown) housed within the footboard and movement of the actuator can automatically or selectively move the display screen between a raised position and lowered position.

FIGS. 24 (with the back support panel 218 in the lowered position) and 25 and 26 (with the back support panel 218 in the raised position) show an alternative bed 210. Bed 210 is identical to bed 10 described in relation to FIGS. 1 to 14 except as described below.

The actuator 226 is not mounted in a vertical orientation on a headboard. Instead, the actuator 226 is mounted substantially horizontally, with a first end fixed to the base 212 of the bed 210, and a second end fixed to the seat support platform 220.

Instead of actuator side brackets 80 drivingly connecting the back support panel 18 to the actuator 26 in bed 10, bed 210 includes a pair of arms 280 which are pivotally connected at each end to the back support platform 218 and the base 212 respectively such that movement of the actuator 226 can move the back support platform 18 between lowered and raised positions.

Operation of the bed 210 is identical to the bed 10 other than the actuator 226 is mounted on the base 212 of the bed to effect relative sliding movement between the support carriage 219 and the base 212 to raise and lower the back support platform 218.

It will be understood that in the above-described beds 10,110, the actuator 26,126 raise and lowers the back support platform 18,118 directly due to the actuator 26,126 being connected directly to the back support platform 18,118. As the back support platform 18,118 is raised or lowered, the support carriage 19,119 slides relative to the base 12,112 due to the indirect connection between the support carriage 19,119 and the back support platform 18,118 via the pivotal connections between the back support platform 18,118, the mattress bend support platform 21,121 and the seat support platform 20,120, the seat support platform 20,120 being slidably fixed to the support carriage 19,119, i.e. the seat support platform 20,120 cannot slide relative to the support carriage 19,119 such that any sliding movement of the seat support platform 20,210 is transferred to sliding movement of the support carriage 19,119.

In contrast, the actuator 226 in bed 210, is directly connected to the seat support platform 220 and therefore the actuator 226 slides the support carriage 219 relative to the base 212. As the support carriage 219 slides relative to the base 212, the platform 218 is raised or lowered due to the indirect connection between the support carriage 219 and the back support platform 218 via the pivotal connections between the back support platform 218, the mattress bend support platform 221 and the seat support platform 220, the seat support platform 220 being slidably fixed to the support carriage 219.

FIGS. 27 and 28 show an alternative bed 310 which is identical to the bed 210 described above except that the mattress bend support platform guide 354 is entirely curved rather than straight. The provision of the curved mattress bend support platform guide 354 further improves the coordinated pivotal movement between the mattress bend support platform 321 and seat support platform 320 and the mattress bend support platform 321 and the back support platform 318 as the back support platform 318 moves between the lowered and raised positions, and ensure that the first angle and the second angle are substantially equal or at the very least are different by less than 10 degrees.

In alternative embodiments to beds 10,110,210,310, the mattress bend support platform guide can include both a curved and a straight portion.

It will be understood that in any of the above-described beds, with the actuator mounted on the headboard as in the beds of FIGS. 1 to 23 or with the actuator mounted on the base as in the beds of FIGS. 24 to 28, the mattress bend support platform guide can be an entirely curved or straight guide, or include both a curved and a straight portion.

FIG. 29 shows an alternative bed 410 which is identical to the bed 110 of FIGS. 15 to 23 except the actuator 426 is mounted horizontal and attached to the headboard 414 rather than vertically. In an alternative embodiment, the actuator can be attached to the base as described in bed 210. It will be understood that the actuator need not be attached to the headboard, and can be attached to any part of the bed which slidably moves relative to the support carriage such that movement of the actuator slidably moves the support carriage relative to the base of the bed and raises and lowers the back support platform.

FIGS. 30 to 37 show an alternative bed 510 (with legs removed) which uses a different mechanism to co-ordinate the pivotal movement between the mattress bend support platform 521 and the lower support platform 520, and the mattress bend support platform 521 and the back support platform 518 as the back support platform 518 moves between lowered and raised positions.

Bed 510 is similar to bed 210 other than as described below.

Bed 510 does not use a mattress bend support platform guide and follower to coordinate the mattress bend support platform movement.

Instead, the bed 510 includes a first connecting means in the form of a pair of first connecting arms 581, a first end of which is pivotally connected to the support carriage 519, a second end of which includes a roller 582 which acts on, and moves translationally relative to, the back support panel 518 to raise and lower the back support panel as will be described below.

Bed 510 further includes a second connecting means in the form of a pair of second connecting arms 583, each of which is pivotally connected, at a first end, part-way along the first connecting arm 581, and at a second end, to a pivotal connection or hinge point 584 between the mattress bend support platform 521 and the seat support platform 520 (note that the seat support platform 520 comprises two hinged parts for storage purposes, with each part remaining fixed relative to the other part during operation of the bed).

In an alternative embodiment, the second connecting means can act directly on the mattress bend support platform rather than the pivotal point connecting the back support platform and the mattress bend support platform.

Bed 510 further includes a third connecting means in the form of a pair of third connecting arms 585, with a first end of each connecting arm 585 pivotally attached to and part-way along the first connecting arm 581. A second end of each third connecting arm 585 pivotally attached to the base 512.

An actuator 526 has a first end pivotally attached to a cross-member 586 which connects the pair of third connecting arms 585, and a second end which is pivotally attached to the base 512. In an alternative embodiment, the first end of the actuator 526 can be connected to the base 512 and the second end pivotally attached to the support carriage 519.

Operation of bed 510 is as follows:

Actuation of the actuator 526 towards a head end of the bed (to the left when viewing FIGS. 35 to 37) causes the third connecting arms 585 to rotate clockwise (when viewing FIGS. 35 to 37) about the pivotal connection on the base 512. As arms 585 rotate clockwise, the first connecting arms 581 rotate anticlockwise, pulling the support carriage 519 rearwards towards the head end of the bed. At the same time, rollers 582 move translationally and act on the back support platform 518 to rotate the back support platform 518 from the lowered to the raised position. As the support carriage 519 move rearwards as the back support panel 518 is raised, the first connecting arms 581 cause the second connecting arms 585 to act on the mattress bend support platform 521. It will be understood therefore that the actuator 526 simultaneously drives the back support platform 518 and the mattress bend support platform 521, with the first connecting arms 581 acting directly on the back support platform 521 and the mattress bend support platform 521 being driven by the second connecting arms 582 via the first connecting arms 581.

Activation of the actuator 526 in the opposite direction lowers the back support platform 518 and pushes the support carriage 519 away from the head end of the bed towards a foot end of the bed.

During movement of the back support platform 518 between the lowered and raised positions, instead of the relative movement between the rollers 56 and the grooves 54 as described in relation to the above-described beds 10,110, 210,310,410 to coordinate the movement of the mattress bend support platform relative to the seat support platform and the back support platform as the back support platform, the coordinates movement is achieved via the actuator 526 driving the first 581 and the second 583 connecting means. The result of this coordinated movement is the same as described in relation to FIG. 10 with the first angle $A_1$ defined between the plane Ps of the seat support platform 220 and a plane $P_M$ defined by the mattress bend support platform 221, and a second angle $A_2$ defined between the plane $P_M$ of the mattress bend support platform 221 and the plane $P_B$ of the back support platform 218 being maintained substantially equal as the back support platform 218 moves between the lowered and raised positions. In an alternative embodiment, the difference between the first angle $A_1$ and the second angle $A_2$ is maintained at less than 10 degrees as the back support platform 218 moves between lowered and raised positions.

FIG. 38 shows an alternative bed 610 (with legs removed) which is identical to the bed 510 of FIGS. 30 to 37 except that the lower support platform 691 comprises a thigh support platform 622 and a foot support platform 624 only, and does not have fixed seat support platform. A pivotal connection 695 between the thigh support platform 622 and the mattress bend support platform 621 is fixed to the support carriage 619 such that the lower support panel 691 slidably moves with the support carriage 619. Bed 610 also differs from bed 510 in that the foot support platform 624 is raised by a different actuator.

Operation of bed 610 is identical to bed 510, except that the second $A_2$ angle is defined between the mattress bend support platform 621 and the plane $P_S$ defined by the support carriage 619.

It will be understood in all of the above-mentioned beds 10-610, that the movement of the support platform enables a user or occupier sat or lying on the bed to maintain position relative to furniture such as a bedside cabinet (not shown) as the back support platform is raised and lowered. Such functionality is called zero-wall functionality, alternatively referred to as a wall hugger bed or a wall proximity bed.

Various features have been described above with reference to the beds described in FIGS. 1 to 39. It will be understood that some of those features need not be limited to the specific embodiment with which they have been exemplified.

By way of example, the first actuator being mounted on the headboard, or arranged substantially vertically, or positioned to pivotally connect at or proximate a second end, need not be limited to a bed with a moveable footboard. Similarly, a bed with a moveable footboard need not be limited to an actuator mounted on the headboard, or arranged substantially vertically, or positioned to pivotally connect at or proximate a second end. Further still, the sliding and pivoting foot support platform need not be limited to the aforementioned actuator position or to a bed with a moveable footboard.

The invention claimed is:

1. A zero-wall adjustable bed (10), comprising:

a base (12), a support carriage (19) on the base (19) and slidably moveable relative to the base (12), an actuator (26), a support platform (16) comprising a back support platform (18), a lower support platform (91) and a mattress bend support platform (21) positioned between the back support platform (18) and the lower support platform (20), the actuator effecting coordinated pivotal movement between the mattress bend support platform (21) and the lower support platform (20), and the mattress bend support platform (21) and the back support platform (18) as the back support platform (18) moves between lowered and raised positions; and the base (12) includes one of a mattress bend support platform guide (54) or follower, and the mattress bend support platform (21) includes the other of a mattress bend support platform guide or follower (56), such that relative movement between the mattress bend support platform guide (54) and the mattress bend support platform follower (56) causes coordinated pivotal movement between the mattress bend support platform (21) and the lower support platform (20), and the mattress bend support platform (21) and the back support platform (18) as the back support platform (18) moves between lowered and raised positions.

2. The zero-wall adjustable bed (10), according to claim 1, wherein:

the lower support platform (91) includes at least one of a seat support platform (20), a thigh support platform (22), and a foot support platform (24).

3. The zero-wall adjustable bed (10), according to claim 2, wherein:

the seat support platform (20) is pivotally attached to the mattress bend support platform (21) and the back support platform (18) is pivotally attached to the mattress bend support platform (21), the actuator effecting coordinated pivotal movement between the mattress bend support platform (21) and the seat support platform (20), and the mattress bend support platform (21) and the back support platform (18) as the back support platform (18) moves between lowered and raised positions.

4. The zero-wall adjustable bed (10), according to claim 1, wherein:

a first angle ($A_1$) is defined between the seat support platform (20) or the support carriage (19) and the mattress bend support platform (21), and a second angle ($A_2$) is defined between the mattress bend support platform (21) and the back support platform (18), in which the difference between the first angle ($A_1$) and the second angle ($A_2$) is less than 10 degrees, preferably substantially equal as the back support platform (18) moves between lowered and raised positions.

5. The zero-wall adjustable bed (10), according to claim 1, wherein:

a third angle ($A_3$) is defined between the seat support platform (20) or the support carriage (19) and the back support platform (18), in which the third angle ($A_3$) is between 0 and 70 degrees as the back support platform (18) moves between lowered and raised positions, preferably the third angle ($A_3$) is less than 70 degrees when the back support platform (18) is in the raised position.

6. The zero-wall adjustable bed (10), according to claim 1, wherein:

at least part of the support platform (16) is slidably fixed to the support carriage (19) such that the support platform (16) is slidable relative to the base (12).

7. The zero-wall adjustable bed (10), according to claim 6, wherein:

the seat support platform (20) is slidably fixed to the support carriage (19).

8. The zero-wall adjustable bed (610), according to claim 6, wherein:

a pivotal connection (695) between the lower support platform (691) and the mattress bend support platform (621) is slidably fixed to the support carriage (619).

9. The zero-wall adjustable bed (10), according to claim 1, wherein:

the mattress bend support platform guide (54) is inclined vertically upwards and rearwards towards a head end of the bed.

10. The zero-wall adjustable bed (310), according to claim 9, wherein:

the mattress bend support platform guide includes a curved portion, and preferably defines a curved portion only (354).

11. The zero-wall adjustable bed (10), according to claim 1, wherein:

the mattress bend support platform guide (54) includes a straight portion, preferably defines a straight portion only.

12. The zero-wall adjustable bed (210), according to claim 1, wherein:

in which the actuator (226) has a first end pivotally attached to the base (212) and a second end pivotally attached to the support carriage (219) such that movement of the actuator effects sliding movement between the support carriage (219) and the base (212).

13. The zero-wall adjustable bed (10), according to claim 1, wherein:

the support carriage (19) slidably moves relative to the base (12) when the back support platform (18) moves between the lowered and raised positions.

14. The zero-wall adjustable bed (10), according to claim 1, wherein:

a movement of the back support platform (18) between the lowered and the raised position causes the support carriage (19) to slide rearwards towards a head end (H) of the bed.

15. A zero-wall adjustable bed (510), comprising:

a base (12), a support carriage (19) on the base (19) and slidably moveable relative to the base (12), an actuator (26), a support platform (16) comprising a back support platform (18), a lower support platform (91) and a mattress bend support platform (21) positioned between the back support platform (18) and the lower support platform (20), the actuator effecting coordinated pivotal movement between the mattress bend support platform (21) and the lower support platform (20), and the mattress bend support platform (21) and the back support platform (18) as the back support platform (18) moves between lowered and raised positions; and a first connecting means (581) which acts directly on the back support platform (518) and a second connecting means (583) which acts directly on the mattress bend support platform or a pivotal point (584) connecting the back support platform (518) and the mattress bend support platform (521) such that the actuator (526) simultaneously drives both support platforms (521, 526), the second connecting means (583) is driven by the actuator via the first connecting means (581), in which the second connecting means (583) is pivotally attached to the first connecting means (581) part-way along the first connecting means (581).

16. The zero-wall adjustable bed (510), according to claim 15, wherein:

the first connecting means (581) has a first end pivotally attached to the support carriage (519), and a second end free to move translationally on the back support platform (518).

17. The zero-wall adjustable bed (510), according to claim 15, further comprising:

a third connecting means (585), the third connecting means (585) is pivotally attached at a first end to the first connecting means (581) and pivotally attached at a second end to the base (512).

18. The zero-wall adjustable bed (10), according to claim 17, wherein:

the actuator (526) has a first end pivotally attached to the third connecting means (585) and a second end pivotally attached to the base (512) such that movement of the actuator effects sliding movement between the support carriage (519) and the base (512).

19. The zero-wall adjustable bed (110), comprising:

a base (12), a support carriage (19) on the base (19) and slidably moveable relative to the base (12), an actuator (26), a support platform (16) comprising a back support platform (18), a lower support platform (91) and a mattress bend support platform (21) positioned between the back support platform (18) and the lower support platform (20), the actuator effecting coordinated pivotal movement between the mattress bend support platform (21) and the lower support platform (20), and the mattress bend support platform (21) and the back support platform (18) as the back support platform (18) moves between lowered and raised positions; and a footboard (160) slidably fixed to the support carriage (119), in which movement of the support carriage (119) relative to the base (112) causes the footboard (160) to slidably move relative to the base (112).

* * * * *